US005854958A

United States Patent [19]

Tanimoto et al.

[11] Patent Number: 5,854,958

[45] Date of Patent: Dec. 29, 1998

[54] IMAGE FORMING APPARATUS HAVING TEST PATTERNS FOR CORRECTING COLOR DISCREPANCY

[75] Inventors: Koji Tanimoto; Kenichi Komiya, both of Kanagawa-ken; Naoaki Ide, Shizuoka-ken, all of Japan

[73] Assignee: Kabushiki Kaisha Toshiba, Kawasaki, Japan

[21] Appl. No.: 625,310

[22] Filed: Apr. 1, 1996

[30] Foreign Application Priority Data

Apr. 5, 1995 [JP] Japan ..... 7-080531

[51] Int. Cl.[6] ..... G03G 15/00; G03G 15/01

[52] U.S. Cl. ..... 399/49; 347/116; 399/301

[58] Field of Search ..... 399/40, 49, 51, 399/72, 160, 179, 299, 301; 347/116

[56] References Cited

U.S. PATENT DOCUMENTS

| | | | |
|---|---|---|---|
| 4,916,547 | 4/1990 | Katsumata et al. | 358/300 |
| 5,115,256 | 5/1992 | Miyagi et al. | 347/116 X |
| 5,287,162 | 2/1994 | Jong et al. | 399/49 |
| 5,384,592 | 1/1995 | Wong | 347/116 |
| 5,418,556 | 5/1995 | Andrews | 347/116 |
| 5,452,073 | 9/1995 | Kataoka | 399/299 |
| 5,523,823 | 6/1996 | Ashikaga | 399/301 X |
| 5,579,092 | 11/1996 | Isobe et al. | 347/116 X |
| 5,627,649 | 5/1997 | Sawayama et al. | 347/116 X |

FOREIGN PATENT DOCUMENTS 4-131872 5/1992 Japan .

*Primary Examiner*—Arthur T. Grimley
*Assistant Examiner*—Sophia S. Chen
*Attorney, Agent, or Firm*—Foley & Lardner

[57] ABSTRACT

An image forming apparatus includes image forming units to transfer images onto an image receiving medium that is moved in a specified direction together with a conveyor belt which conveys the image receiving medium. The image forming units of the apparatus form test patterns on the conveyor belt or the image receiving medium. The test patterns include a leading edge and a trailing edge along the specified direction defining a distance therebetween, the distance varying continuously. The apparatus further includes a first detector for detecting the timing of the leading edge and the trailing edge of a test pattern crossing the first detector downstream of the image forming units, a second detector for detecting a shift of an image formed by the image forming units from a proper position based on the difference in the detected timings from the leading edge to the trailing edge of the test pattern detected by the first detector, and a correction unit for correcting a shift of an image formed by the image forming units based on the shifted position of the image detected by the second detector.

21 Claims, 25 Drawing Sheets

MAIN SCANNING DIRECTION
SUB-SCANNING DIRECTION
FIRST COLOR
SECOND COLOR
SUPERPOSED COLOR IMAGES
NORMAL

COLOR DEVIATION IN MAIN SCANNING DIRECTION

COLOR DEVIATION IN SUB-SCANNING DIRECTION

COLOR DEVIATION BY TILT OF IMAGE FORMING UNIT

COLOR DEVIATION CAUSED BY MAGNIFICATION DEVIATION IN MAIN SCANNING DIRECTION

IMAGE FORMING APPARATUS HAVING TEST PATTERNS FOR CORRECTING COLOR DISCREPANCY

BACKGROUND OF THE INVENTION

1. Field of the Invention

The present invention relates to a transfer type color image forming apparatus which forms images of color components on a plurality of photosensitive drums and superposing them on a paper, and is usable for a color printer or a color digital copying machine.

2. Description of the Related Art

The transfer type color image forming apparatus has a first through a forth image forming units to form color images based on four image data of yellow (hereinafter referred to as Y), magenta (a kind of red, hereinafter referred to as M), cyan (bluish purple, hereinafter referred to as C) and black (hereinafter referred to as BK) which are decomposed according to the well known subtractive & mixing process, a paper conveying mechanism to convey paper carrying images formed by the first through the fourth image forming units and a fixing device to fix toner images on a paper conveyed via the paper conveying mechanism.

The first through the fourth image forming units contain photosensitive drums to carry electrostatic latent images corresponding to image data decomposed to respective color components.

In the vicinity of each of the photosensitive drums, there are a charging device, an exposing device or an imaging bar, a developing device and a transfer device provided in order. The charging device supplies specified uniform electric charge to the surface of each photosensitive drum. The exposing device forms an electrostatic latent image on each photosensitive drum by applying a laser beam corresponding to image data on the charged photosensitive drum. The developing device forms a toner image by developing an electrostatic latent image formed on each photosensitive drum in corresponding color toner. The transfer device transfers a toner image formed on the photosensitive drums on a paper conveyed by the paper conveying mechanism. A paper is conveyed successively to the first through the fourth image forming units and the color toner images formed on respective photosensitive drums are superposed and transferred on the paper. Further, the exposure point of the exposing device is positioned between the charging device and the developing device. As an exposing device, an imaging bar such as an LED head, a phosphor head or a laser exposing device using a semiconductor laser can be used.

The paper conveying mechanism contains a conveyer belt formed in an endless shape and movable in a specified direction between the photosensitive drums and the transfer devices of the first through the fourth image forming units. Toner images formed by respective image forming units corresponding to respective color components are superposed on a paper at respective transfer devices by moving the conveyer belt at a fixed speed in the state with a paper electrostatically adsorbed thereto. Further, the conveyer belt conveys a paper with toner images transferred to the fixing device at the rear stage.

The fixing device, containing a pair of upper and lower heating mechanisms which are formed in a roller shape, fuses and fixes a toner image on a paper by heating a paper and a toner image on the paper when the paper passes between the upper and lower heating mechanisms.

By the way, on this kind of transfer type color image forming apparatus, if toner images in respective color components are not accurately superposed successively on a paper, a color deviation is produced. Causes for this color deviation are an inclined or positional deviation peculiar to respective image forming units, a timing deviation when an image is formed by respective image forming units and a deviation of a transfer position when images are superposed on a paper.

From this, an image forming apparatus is constructed using extremely precise component parts, or when assembling a time-consuming adjusting process is provided and a precise adjustment is performed. However, this method has such problems that component parts of an apparatus become extremely expensive, the adjustment work when assembling an image forming apparatus becomes complicated and assembly cost increases. Furthermore, this method may cause problems that, for instance, when replacing a specific image forming unit, part costs may become high and readjustment by a user may become difficult.

On the other hand, a method has been proposed to automatically detect a deviation of images formed by respective image forming units by incorporating, for instance, a CCD sensor in an image forming apparatus and automatically correct the color discrepancy by correcting the relative position of an exposing device to photosensitive drums or positions of respective image forming units based on a size of the detected image deviation. However, as a CCD sensor is extremely expensive, a price of an image forming apparatus increases if a CCD sensor is incorporated in the apparatus and this will result in an increase of running cost, which is disadvantageous to the user.

SUMMARY OF THE INVENTION

It is an object of the present invention to provide an image forming apparatus which does not produce a color discrepancy when superposing toner images corresponding to color components.

According to the present invention, there is provided an image forming apparatus which has image forming means to transfer images on an image receiving medium that is moved in a specified direction together with a conveying means which conveys the image receiving medium, the apparatus comprising means for forming test patterns on the conveying means or the image receiving medium by the image forming means, the test patterns including a leading edge and a trailing edge along the specified direction defining a distance therebetween, the distance varying continuously; first detection means for detecting the timing of the leading edge and the trailing edge of the test pattern crossing the first detection means downstream of the image forming means; second detection means for detecting a shift of an image formed by the image forming means from a proper position based on the difference in the detected timings from the leading edge to the trailing edge of the test pattern detected by the first detection means; and means for correcting a shift of an image formed by the image forming means based on the shifted position of the image detected by the second detection means.

DETAILED DESCRIPTION OF THE PREFERRED EMBODIMENTS

Hereinafter, one preferred embodiment of the present invention will be described referring to the attached drawings.

Figure 1:
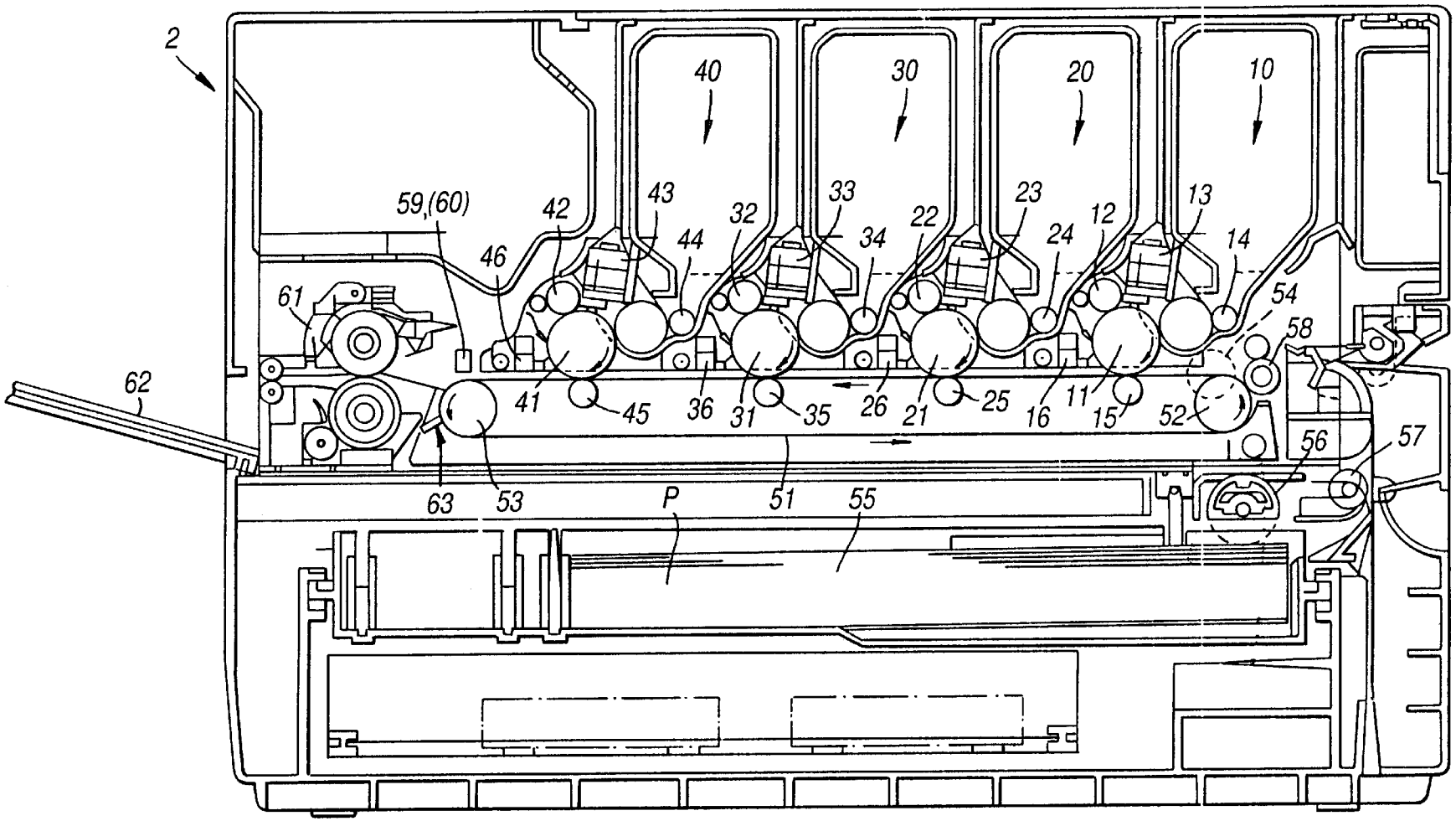
FIG. 1 is a schematic sectional view of an image forming apparatus of the present invention with a deviation detecting mechanism.
Figure 2:
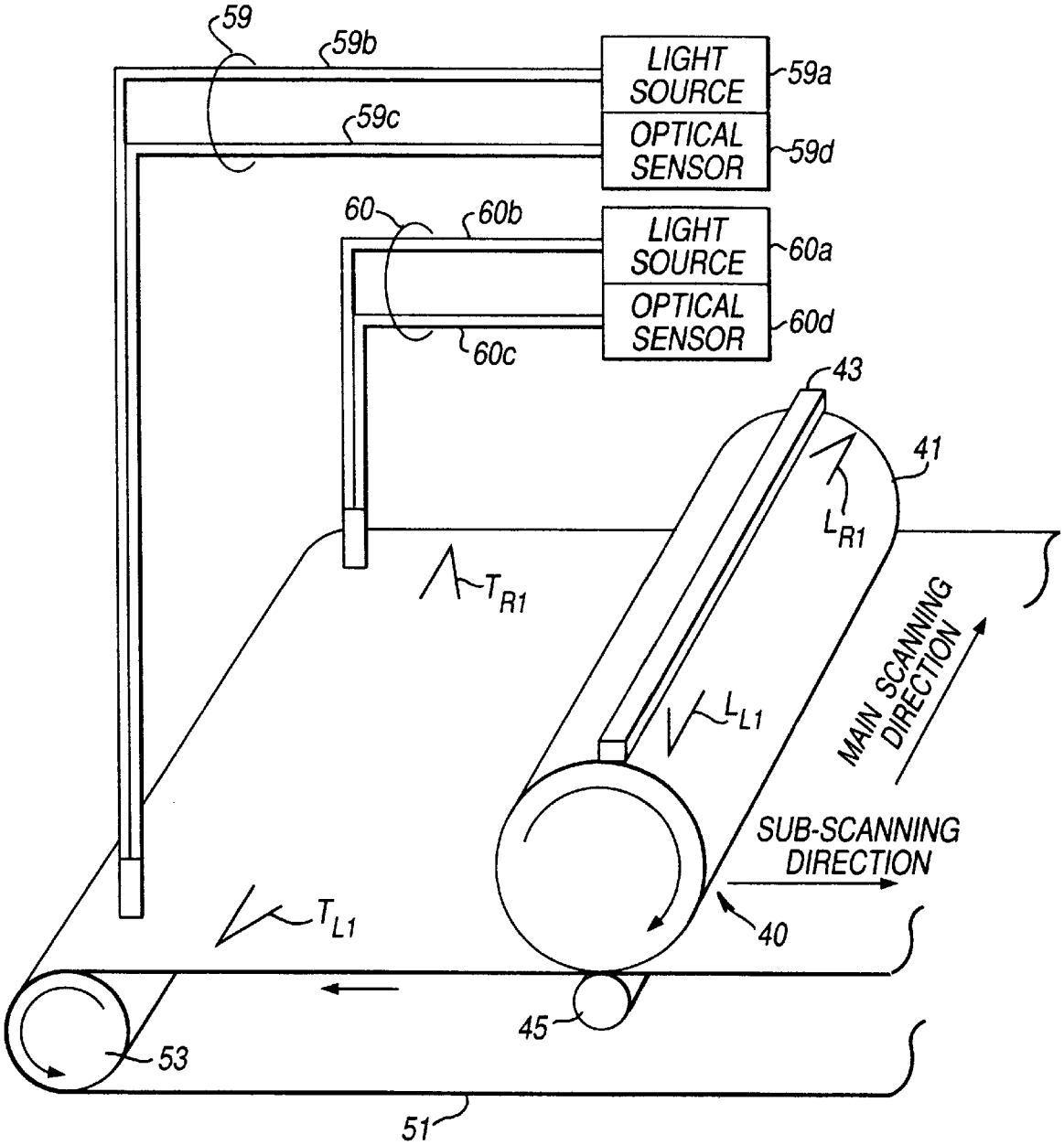
FIG. 2 is a schematic diagram showing a deviation detecting mechanism to detect an image deviation, which is a first embodiment of the present invention.

FIGS. 1 and 2 show a transfer type color image forming apparatus to which the embodiments of the present invention are applied. Further, FIG. 2 is a partial schematic diagram showing the deviation detecting mechanism extracted from the image forming apparatus shown in FIG. 1.

As shown in FIG. 1, an image forming apparatus 2 has a first through a fourth image forming units 10, 20, 30 and 40 which form images decomposed in respective color components and a conveyer belt 51 which conveys images formed by the image forming units 10, 20, 30 and 40 in the arrow direction. Further, the image forming units 10, 20, 30 and 40 are arranged in series along the conveyer belt 51.

The image forming units 10, 20, 30 and 40 contain photosensitive drums 11, 21, 31 and 41 as image carriers of which outer surfaces are formed rotatable in the same direction at the positions in contact with the conveyer belt 51.

The photosensitive drums 11, 21, 31 and 41 are so arranged that their shaft lines become orthogonal to the direction in which images are conveyed by the conveyer belt 51. As shown in FIG. 2, the direction of shaft lines of the photosensitive drums is expressed as the main scanning direction and the rotating direction of the photosensitive drums, that is, the rotating direction of the conveyer belt 51 is expressed as the sub-scanning direction.

Around the photosensitive drums 11, 21, 31 and 41, charging rollers 12, 22, 32 and 42 as the charging means, imaging bars 13, 23, 33 and 43 as latent image forming means, developing devices 14, 24, 34 and 44, transfer rollers 15, 25, 35 and 45 as transfer means, and cleaners 16, 26, 36 and 46 all of which are extended in the main scanning direction have been arranged in order along the rotating direction of the corresponding photosensitive drums. Further, each of the imaging bars 13, 23, 33 and 43 is comprised of a plurality of light sources, for instance, LED heads or phosphor heads arranged in one line.

The imaging bars 13, 23, 33 and 43 record latent images corresponding to image data which are changed via an image data controller and an image data processor that will be described later on the photosensitive drums 11, 21, 31 and 41 corresponding to respective imaging bars in order to correct such factors for color discrepancies as tilt deviations, magnification errors in the main scanning direction, write positions in the main scanning direction and write timings in the sub-scanning direction.

The image forming units 10, 20, 30 and 40 form images corresponding to decomposed color components, that is, yellow (hereinafter, referred to as Y) image, magenta (a kind of red, hereinafter, referred to as M) image, cyan (bluish purple, hereinafter, referred to as C) image and black (hereinafter, referred to as BK) image. Further, in this embodiment, the image forming units 10, 20, 30 and 40 correspond to Y, M, C and BK images, respectively. Accordingly, color developers or toners corresponding to Y, M, C and BK are contained in the developing devices 14, 24, 34 and 44.

The conveyer belt 51 is rotated in the arrow direction with the counterclockwise rotation of supporting rollers 52 and 53. Further, one of the supporting rollers 52 and 53, for instance, the supporting roller 52 which is arranged in close vicinity to the image forming unit 10 is rotated by a driving motor 54.

There is a cassette 55 containing an image receiving medium, for instance, paper P arranged below the conveyer belt 51. Paper P contained in the cassette 55 is taken out of the cassette 55 by a paper supply roller 56 which is rotated at a specified timing and is guided to an aligning roller 58 via a feed roller 57.

At the downstream side in the rotating direction of the conveyer belt 51, there are two sets of registration sensors 59 and 60 arranged for detecting a test pattern image (will be described later) recorded on the conveyer belt 51 and a reference line "ref" (will be described later) formed in advance on the conveyer belt at a specified interval in the main scanning direction as shown in FIG. 2.

In the vicinity of the supporting roller 53, there is arranged a fixing device 61 for fixing toner images in respective colors superposed on a paper P on the conveyer belt 51. Further, at the outside of the color image forming apparatus 2, a tray 62 is provided to retain ejected paper P carrying a toner image fixed by the fixing device 61. Further, in the vicinity of the supporting roller 53, a belt cleaner 63 is provided to remove toners adhered to the conveyer belt 51 and paper refuse and the like produced from paper P.

Figure 3:
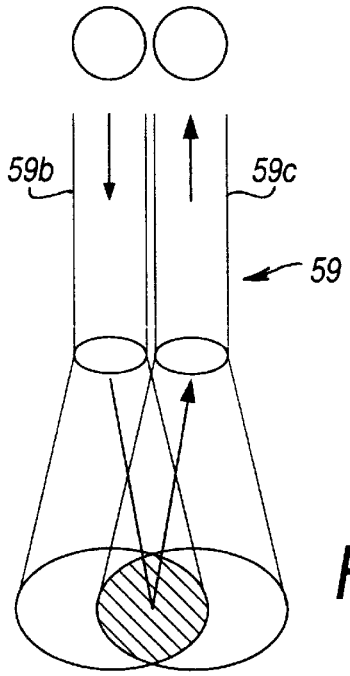
FIG. 3 is a schematic diagram showing a deviation detecting unit of the deviation detecting mechanism shown in FIG. 2.

In FIG. 3, one example of the registration sensors 59 and 60 shown in FIG. 2 is shown. Further, as the registration sensors 59 and 60 are substantially in the same construction, the first registration sensor 59 will be explained as a representative sensor.

The first registration sensor 59 is comprised of a light source 59*a*, a first optical fiber 59*b*, a second optical fiber 59*c* and an optical sensor 59*d*. The first optical fiber 59*b* guides the light from the light source 59*a* to a specified position of the conveyer belt 51. The reflected light from the conveyer belt 51 is guided to the second optical fiber 59*c* and then, led to the optical sensor 59*d* provided near the light source 59*a*. Further, the first and the second optical fibers 59*b* and 59*c* are adjacent to each other in the main scanning direction and arranged at right angles to the surface of the conveyer belt 51. FIG. 2 also shows test patterns $T_{R1}$ and $T_{L1}$ and corresponding latent images $L_{R1}$ and $L_{L1}$.

When the registration sensors 59 and 60 of such construction are used, a test pattern image recorded on the conveyer belt 51 and the reference line "ref" (will be described later) formed in advance on the conveyer belt 51 can be detected. Further, a sensor using optical fibers is taken as an example here but if a test pattern image recorded and the reference line recorded on the conveyer belt 51 can be detected, any other sensor may be used.

Figure 4:
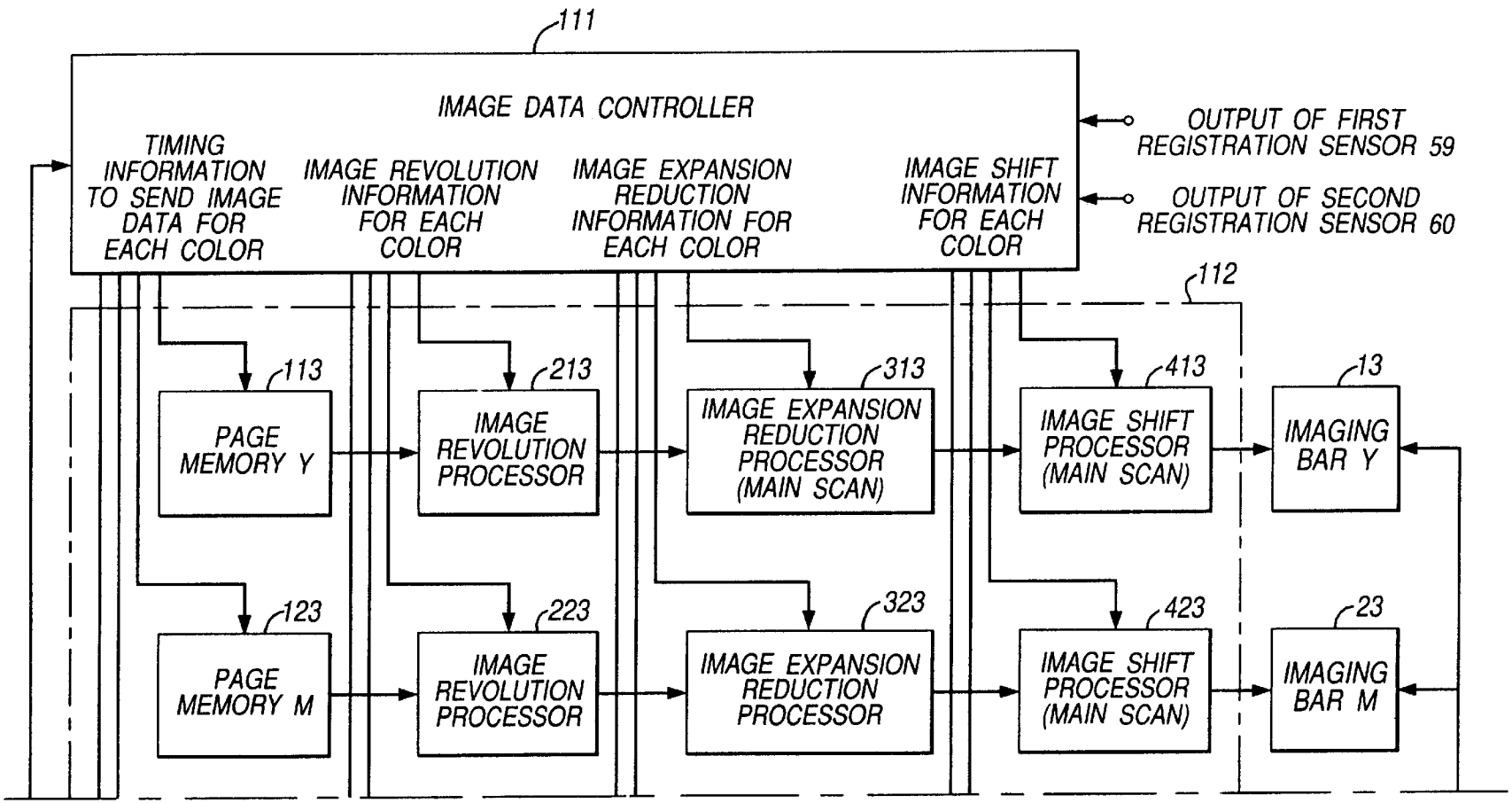
FIG. 4 is a schematic block diagram showing a controller of the image forming apparatus shown in FIG. 1.
Figure 4:
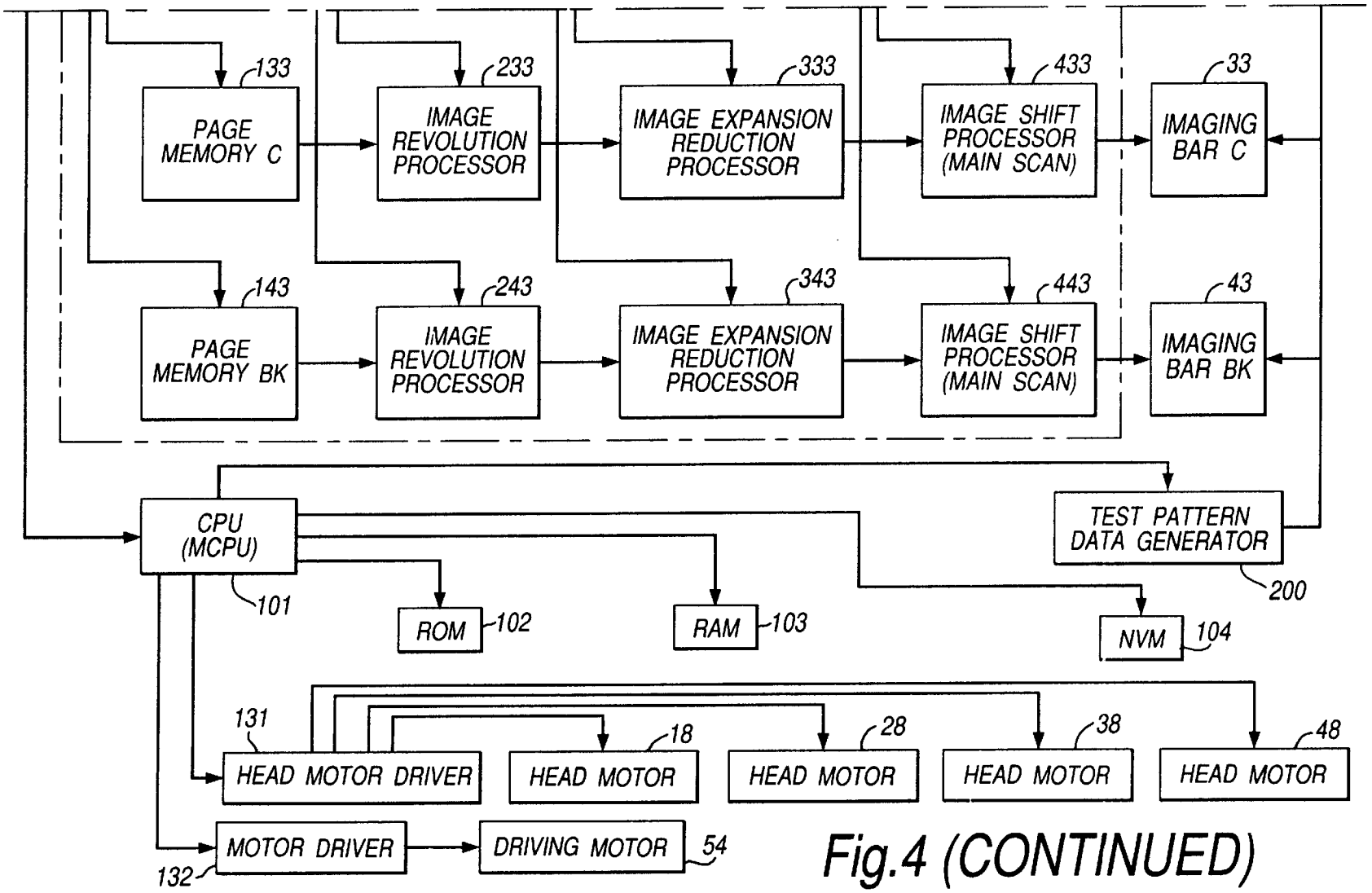

FIG. 4 shows the controller of the image forming apparatus shown in FIG. 1 schematically. As shown in FIG. 4, the controller of the image forming apparatus is comprised of a CPU 101, which is the main controller, that is, a main CPU (MCPU), a read only memory (hereinafter, referred to as ROM) 102, a random access memory (hereinafter, referred to as RAM) 103 and a non-volatile memory (hereinafter, referred to as NVM) 104. The ROM 102 stores initial data which are used for initializing the image forming apparatus by the CPU 101. The RAM 103 contains a buffer memory and is used for tentative storage of image data input from an external device (not shown) and for development of image data to be printed. The NVM 104 stores various control data computed for correction of color discrepancy.

Image detecting signals from the first registration sensor 59 and those from the second registration sensor 60 are input to the CPU 101 via an image data controller 111.

The CPU 101 is connected with an image data control circuit 112 which changes image data to be supplied to the imaging bars 13, 23, 33 and 43 of the first through the fourth image forming units for correction of color discrepancy according to a specified rule. This image data control circuit 112 is comprised of page memories 113, 123, 133 and 143, image revolution processors 213, 223, 233 and 243, image expansion reduction processors 313, 323, 333 and 343, and image shift processors 413, 423, 433 and 443. The CPU 101 is further connected with a head driving device (not shown) for having the light sources of respective imaging bars emit light based on the image data changed by the image data control circuit 112.

In addition, the CPU 101 is connected with a test pattern data generator 200 for recording test pattern images, which will be described later, on the photosensitive drums 11, 21, 31 and 41 using the imaging bars 13, 23, 33 and 43. The controller also includes head motors 28, 38, and 48 and a motor driver 132.

Next, the operation of the image forming apparatus shown in FIGS. 1, 2 and 4 will be described in detail.

When a power switch (not shown) is turned ON, the image forming apparatus 2 is initialized and kept in the standby state.

Hereinafter, the process in which a Y (yellow) image is formed is described referring to the first image forming unit 10. Further, M (magenta) image, C (cyan) image and BK (black) image are also formed in the same process by the second through the fourth image forming units 20, 30 and 40, respectively.

The photosensitive drum 11 rotates in the arrow direction in the figure and its surface is uniformly charged by the charging roller 12. In succession, a Y (yellow) electrostatic latent image corresponding to an image data is formed on a specified position of the photosensitive drum 11 by the exposure by the imaging bar 13.

The latent image formed on the photosensitive drum 11 is developed by the developing device 14 containing Y (yellow) toner and changed to a Y toner image.

The Y toner image on the photosensitive drum 11 is transferred on a paper P by the transfer roller 15. That is, the paper P is aligned by the aligning roller 58 after taken out of the cassette 55. Thereafter, the paper P is conveyed to a position opposite to the photosensitive drum 11 while kept adsorbed on the conveyer belt 51 and the Y toner image is transferred on the paper P by the transfer roller 15 at the position opposite to this photosensitive drum 11.

Hereafter, an M toner image, a C toner image and a BK toner image formed on the photosensitive drums 21, 31 and 41 are superposed in order on the paper P being conveyed by the conveyer belt 51 by the second, third and fourth image forming units 20, 30 and 40, respectively. That is, when printing multiple colors, an image forming operation of one cycle process of charging, exposure, development and transfer is executed by the image forming units 10, 20, 30 and 40, and toner images in multiple colors are transferred multiply.

Further, untransferred toners left on the photosensitive drums 11, 21, 31 and 41 are cleaned by the cleaners 16, 26, 36 and 46, respectively.

The paper P with the colored toner images transferred is separated from the conveyer belt 51, conveyed to the fixing device 61, the toner images heated by the fixing device 61 are melted and fixed and then, ejected onto the tray 62.

Further, toners adhered to the conveyer belt 51 and paper refuse produced from a paper P are removed by a belt cleaner 63.

As a color discrepancy tends to occur when a plurality of images formed in color components are superposed on a paper P on this type of image forming apparatus, various methods for superposing images in different colors have been so far proposed. Here, causes for generating deviations will be pursued and a method to remove the causes will be explained.

Kinds and features of image deviations are shown in FIGS. 5A through 5D.

Figures 5A, 5B, 5C, 5D, 5E:
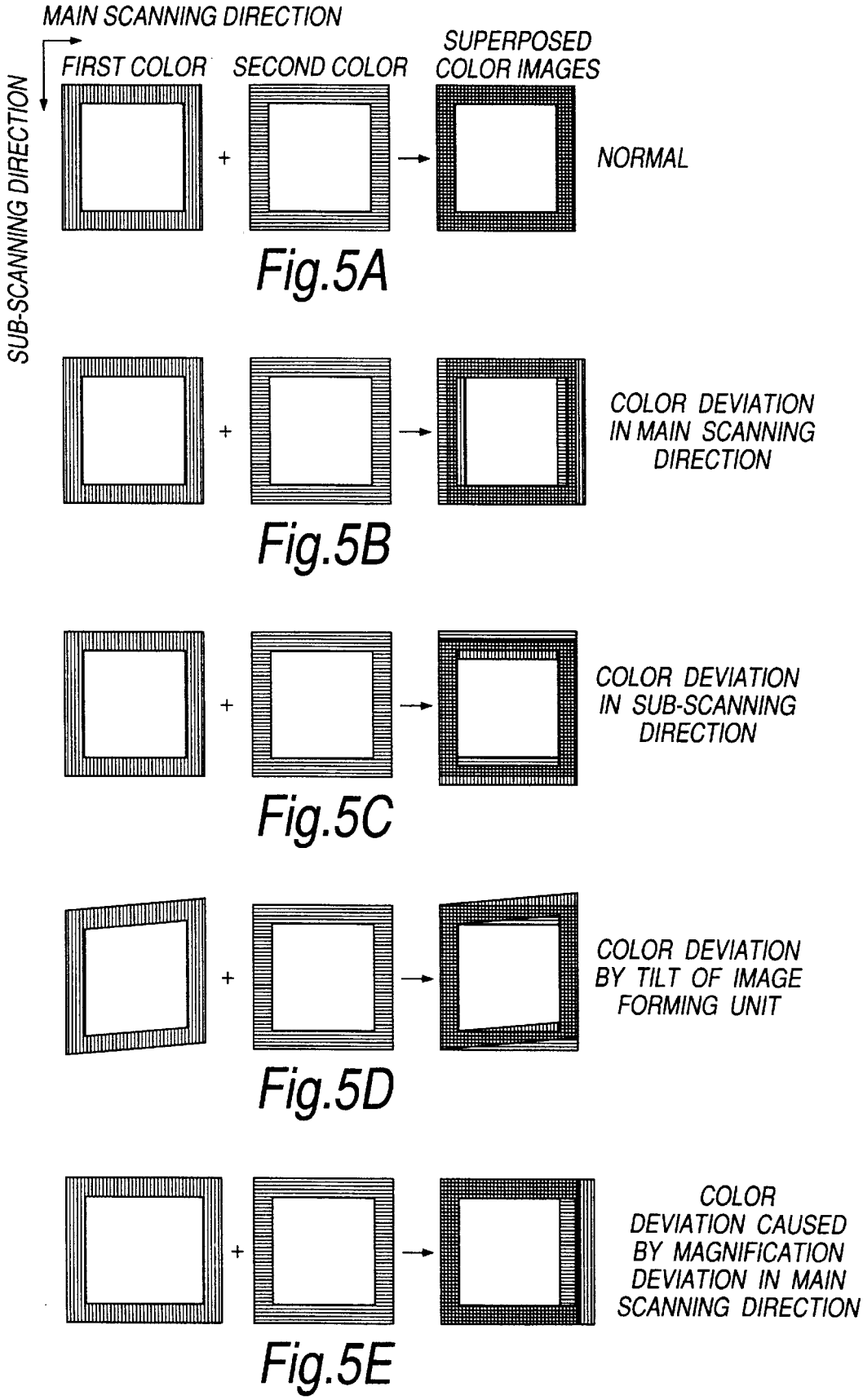
FIGS. 5A through 5E are schematic diagrams showing examples of superposed images.

As shown in FIG. 5A, when a first color toner and a second color toner corresponding to substantially equal image data are accurately superposed each other, a toner image that is combining the first and the second color toners is formed in the normal state. For instance, if the first color toner is yellow Y and the second color toner is magenta M, a red image without color deviation is obtained as it is the subtractive & mixing process.

However, it is known that in many cases a deviation of the shaft line between the photosensitive drum and the imaging bar in each image forming unit, a deviation of space between the image forming units and a mounting deviation of the photosensitive drum and the imaging bar are produced. For instance, FIG. 5B shows a color deviation in the main scanning direction where the first color toner image and the second color toner image deviate in the main scanning direction. FIG. 5C shows a color deviation in the sub-scanning direction where the first color toner image and the second color toner image deviate in the sub-scanning direction. FIG. 5D shows a tilt deviation of the first and the second color toner images in both the main scanning and sub-scanning directions.

Figure 22:
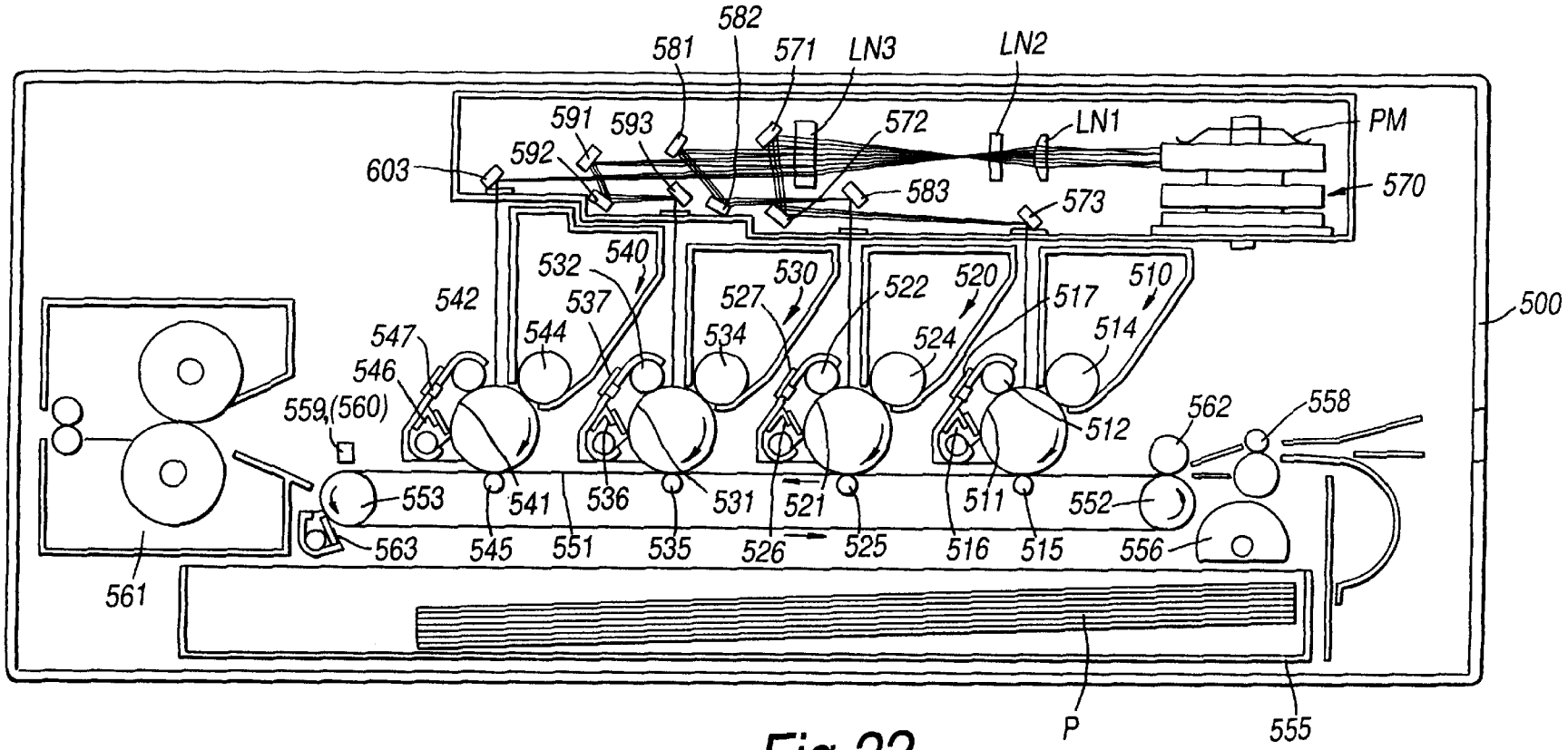
FIG. 22 is a schematic sectional view showing an example of the deviation detecting mechanism of the present invention applied to a recording system differing from the image forming apparatus shown in FIG. 1.

Further, when the image forming apparatus is a laser beam printer using the laser beam as shown in FIG. 22, a magnification deviation causing a color deviation in the main scanning direction may be caused as shown in FIG. 5E.

Next, a method to remove a color deviation of a color image formed by the image forming units 10, 20, 30 and 40 of the image forming apparatus 2 will be explained in detail.

When the image forming apparatus 2 is set in the adjusting mode by an operating panel (not shown), a test pattern printing is instructed to the first through the fourth image forming units 10, 20, 30 and 40 and the test pattern data generator 200 by the CPU 101. Further, in this adjusting mode, the paper P is not conveyed by the paper supply roller 56 from the cassette 55 and the conveyer belt 51 only is rotated at a specified speed.

Figure 6:
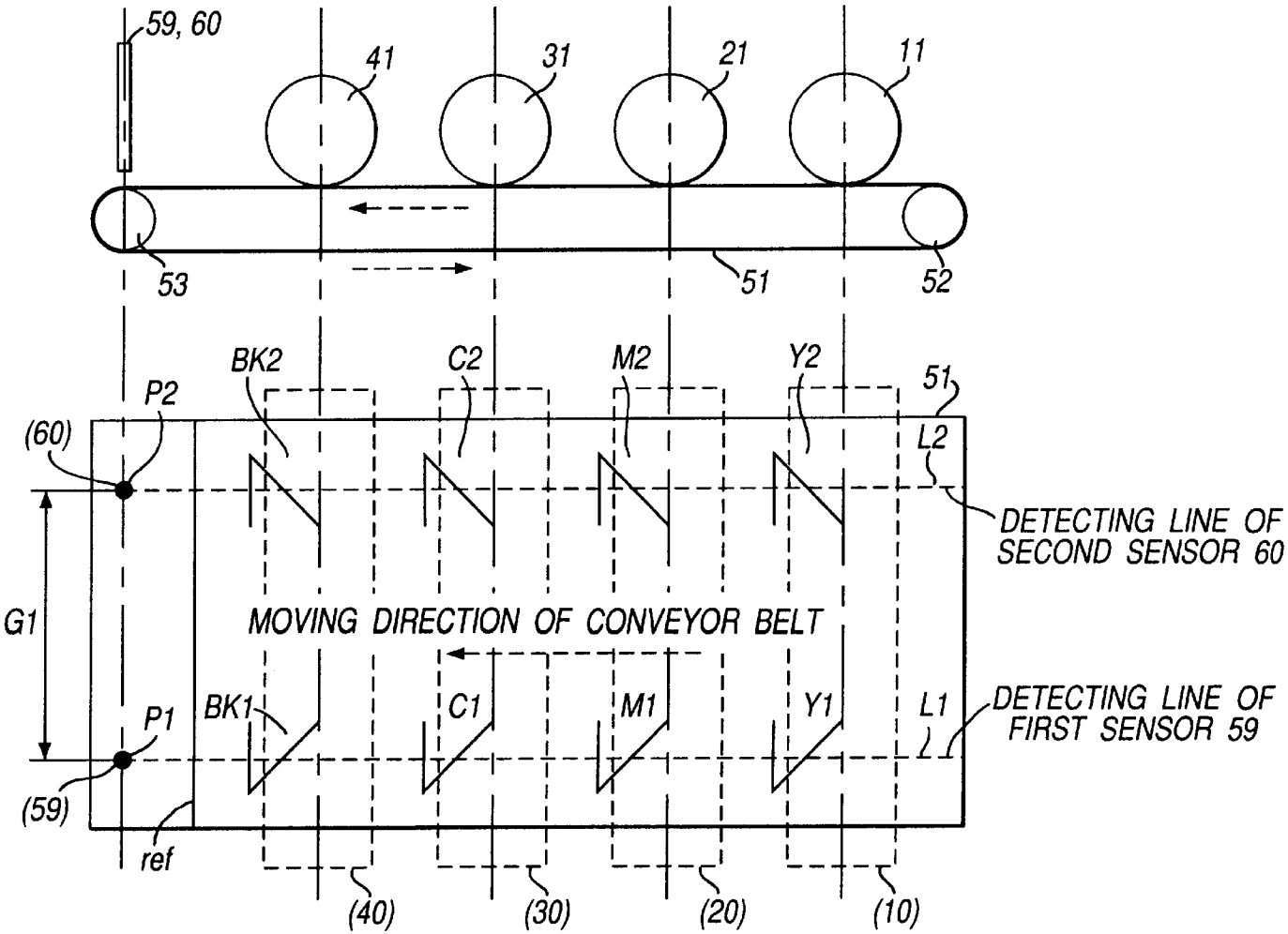
FIG. 6 is a schematic diagram showing the positional relationship of test patterns formed on the deviation detecting mechanism and a conveyer belt shown in FIG. 2.

In FIG. 6, the positional relationship between the first and second registration sensors 59 and 60 and the first through the fourth test pattern images BK1 and BK2, C1 and C2, M1 and M2 and Y1 and Y2 which are recorded on the conveyer belt 51 by the image forming units 10, 20, 30 and 40 are schematically shown. The first and the second registration sensors 59 and 60 are arranged along the main scanning direction orthogonal to the moving direction (hereinafter, referred to as the sub-scanning direction) of the conveyer belt 51 with a specified distance G1, for instance, 200 mm.

The test pattern detecting positions by the first and the second registration sensors 59 and 60 to the conveyer belt 51 are shown as P1 and P2, respectively and the positions of the conveyer belt 51 passing these detecting positions are shown as detecting lines L1 and L2. On the conveyer belt 51, the reference line "ref" has been formed to check the relative positional relationship in the sub-scanning direction of the first and the second registration sensors 59 and 60.

The test pattern images BK1 and BK2 formed on the photosensitive drum 41 are transferred on the conveyer belt 51 by the transfer roller 45. That is, in the adjusting mode the paper P is not used and the test pattern images BK1 and BK2 are transferred directly on the conveyer belt 51.

The test pattern images BK1 and BK2 transferred on the conveyer belt 51 are moved to the fixing device 61 side with the rotation of the conveyer belt 51 and guided to the detecting area opposite to the first registration sensor 59 and the second registration sensor 60.

When the test pattern image BK1 passes through the lighting areas by the first optical fiber 59*b* of the first registration sensor 59, that is, the detecting position P1, the reflected light from the conveyer belt 51 guided by the second optical fiber 59*c* is photoelectrically converted and a pulse signal corresponding to the test pattern image BK1 is input to the image data controller 111. Further, when the test pattern image BK2 passes through the lighting area by the first optical fiber 60*b* of the second registration sensor 60, that is, the detecting position P2, the reflected light from the conveyer belt 51 guided by the second optical fiber 60*c* is photoelectrically converted by the optical sensor 60*d* and a pulse signal corresponding to the test pattern image BK2 is input to the image data controller 111.

Accordingly, a time from when electrostatic latent images corresponding to the test pattern images BK1 and BK2 are formed on the photosensitive drum 41 by the imaging bar 43 of the fourth image forming unit 40 until the electrostatic latent images corresponding to the test pattern images BK1 and BK2 are developed by the developing device 44, transferred along the detecting lines L1 and L2 on the conveyer belt 51 and pass the detecting positions P1 and P2 of the first and the second registration sensors 59 and 60 is accurately measured by the CPU 101. The reference line "ref" is to check the relationship of relative positions between the first and the second registration sensors 59 and 60 and it is possible to measure the relationship of relative positions in the belt conveying direction (the sub-scanning direction) of the first and the second registration sensors 59 and 60 by driving the conveyer belt 51 and monitoring the signal output timings of the first and the second registration sensors 59 and 60.

Thereafter, a time from when electrostatic latent images corresponding to test pattern images C1 and C2 are formed on the photosensitive drum 31 by the imaging bar 33 of the third image forming unit 30 until the test pattern images C1 and C2 pass the detecting positions P1 and P2 of the first and the second registration sensors 59 and 60 is measured by the CPU 101. Then, a time from when electrostatic latent images corresponding to test pattern images M1 and M2 are formed on the photosensitive drum 21 by the imaging bar 23 of the second image forming unit 20 until the test pattern images M1 and M2 pass the detecting positions P1 and P2 of the first and the second registration sensors 59 and 60 is measured by the CPU 101. Then, a time from when electrostatic latent images corresponding to test pattern images Y1 and Y2 are formed on the photosensitive drum 11 by the imaging bar 13 of the first image forming unit 10 until the test pattern images Y1 and Y2 pass the detecting positions P1 and P2 of the first and the second registration sensors 59 and 60 is measured by the CPU 101.

By the way, if the first and the second registration sensors 59 and 60 have been arranged in the state shifted in the sub-scanning direction, an equal sized deviation is included in the test pattern images BK1 and BK2, C1 and C2, M1 and M2, and Y1 and Y2, respectively. This will make it possible that when sensing various deviations described later, even if detecting positions P1' and P2' (along lines L1' and L2') by the first and the second registration sensors 59 and 60 are shifted mutually as shown in FIG. 7, they can be replaced to the state of P1 and P2 which are not shifted and treated in the same manner as in the system (the relationship of positions) shown in FIG. 6.

Figure 8:
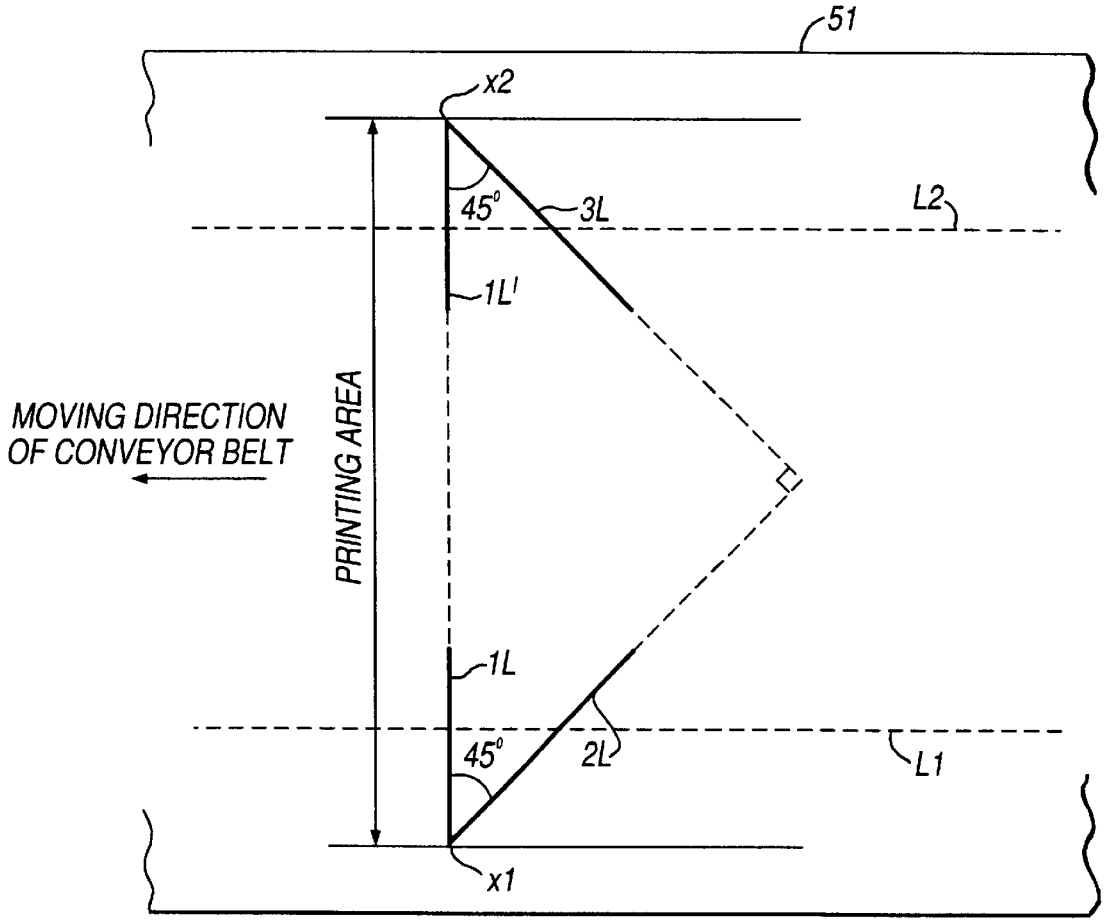
FIG. 8 is a schematic diagram showing the principle that a deviation can be detected by the deviation detecting mechanism shown in FIG. 2.
Figure 7:
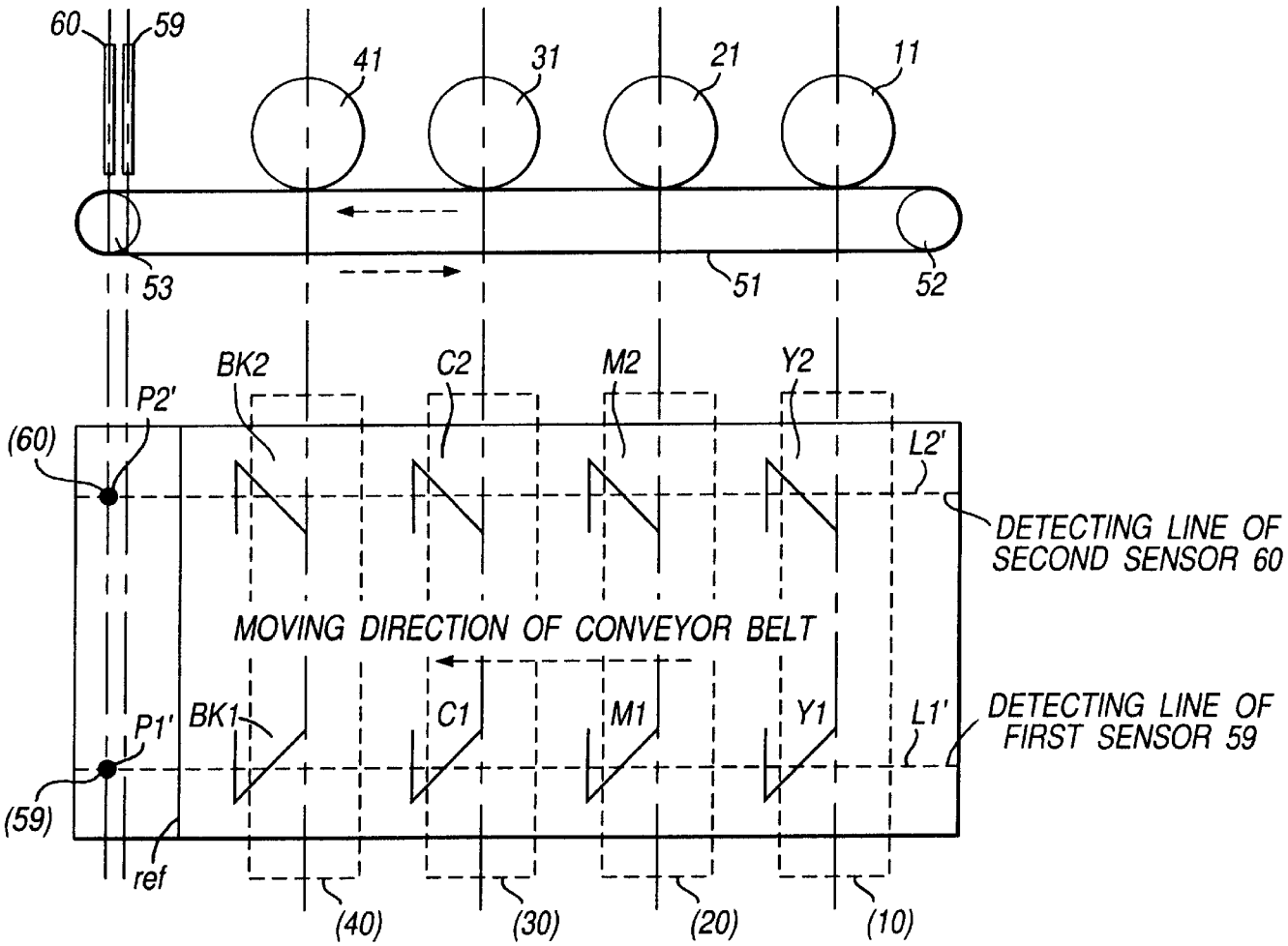
FIG. 7 is a schematic diagram showing the state wherein the deviation detecting mechanism has a peculiar deviation in the positional relationship of the deviation detecting mechanism shown in FIG. 2 with a test pattern image formed on the conveyer belt.

FIG. 8 shows characteristics of the test pattern images shown in FIGS. 6 and 7 in detail.

As shown in FIG. 8, a pair of test pattern images BK1 and BK2, C1 and C2, M1 and M2, and Y1 and Y2 are formed by first line 1L and 1L' arranged longer than a distance G1 along the main scanning direction and second and third straight lines 2L and 3L which are not in parallel with the first lines 1L and 1L' and are crossing the first lines 1L and 1L' at an angle of desirably 45 degrees so as to positively pass near the detecting positions by the first and the second registration sensors 59 and 60, which are arranged at the distance G1 (FIG. 6) in the main scanning direction. Therefore, the extension lines of the second and the third straight lines 2L and 3L cross each other at a right angle. Further, a distance between a crossing position X1 of the first and the second lines 1L and 2L and a crossing position X2 of the first and the third straight lines 1L' and 3L, that is, a distance between the write start position and the write end position of the first line 1L and 1L' in the main scanning direction is defined at a specified position which meets, for instance, the maximum recordable printing width of each imaging bar, that is, a printing width peculiar to each imaging bar or a recordable paper width of the image forming apparatus 2. It is sufficient that the first through the third straight lines 1L, 1L', 2L and 3L are recorded in a specified length so that they come to near the detecting positions P1 and P2, that is, the detecting lines L1 and L2 on the conveyer belt 51.

FIGS. 9A through 9E show the relationship between the test pattern images recorded on the conveyer belt 51 and the output signals from the registration sensors. As to the first straight line 1L' and the third straight line 3L shown in FIG. 8, they are substantially the same as the relationship between the first and the second straight lines 1L and 2L shown in FIG. 9A and therefore, the relationship between the first and the second straight lines 1L and 2L only will be described here.

Figure 9A:
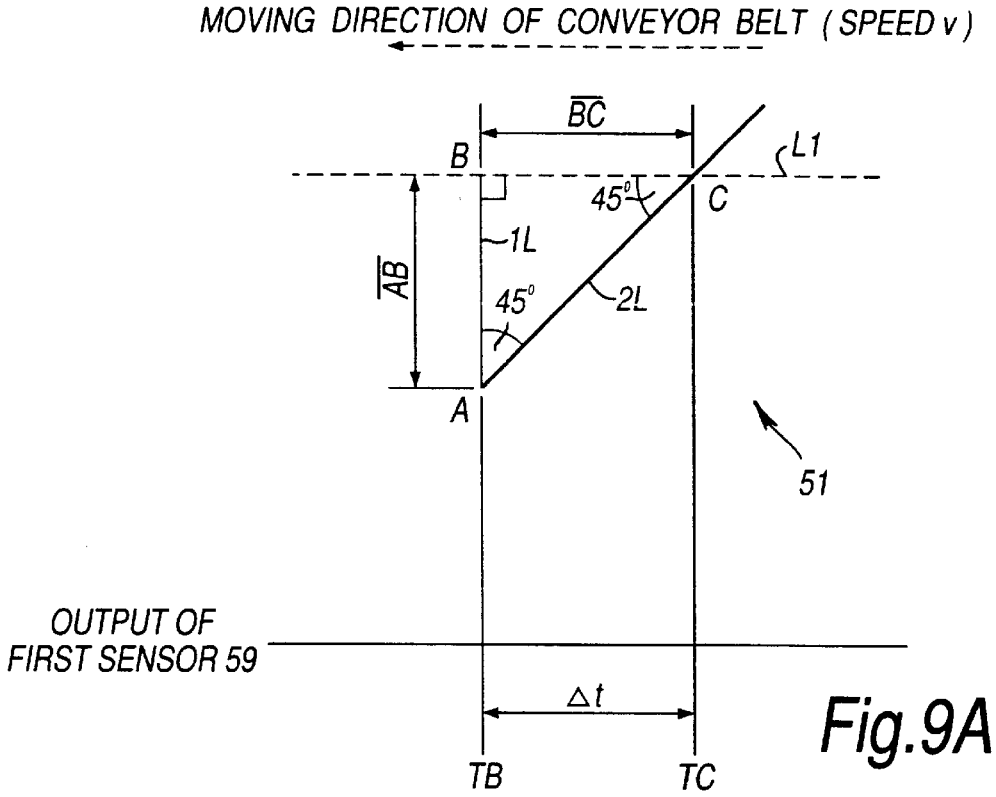
FIGS. 9A through 9E are schematic diagrams showing the principle that deviations of various test pattern images in the main scanning direction can be detected by the deviation detecting mechanism shown in FIG. 2.

As shown in FIG. 9A, assuming that the intersecting point of the first and the second straight lines 1L and 2L is a vertex A, that of the first straight line 1L and the detecting line L1 of the first registration sensor 59 is a vertex B, and that of the second line 2L and the detecting line L1 of the first registration sensor 59 is a vertex C, the first registration sensor 59 outputs a sensing signal at two points, that is, when the vertex B passes the detecting position P1 (TB) and when the vertex C passes the detecting position P1 (TC).

Here, assuming that a moving speed of the conveyer belt 51 is v and a time difference between two times of the outputs of the first registration sensor is $\Delta t$ ($\Delta t$=TB−TC), from BC=v$\Delta t$, a distance BC on the detecting line L1 is obtained.

Then, a distance AB will be considered. If the side AB of a triangle ABC is at a right angle to L1, this triangle becomes an isosceles equilateral triangle with B as the vertex. In this case, the length AB of the first line 1L from the detecting line L1 to the end of the conveyer belt 51 can be approximated from BC=v$\Delta t$=AB. Here, the length AB of the first line 1L corresponds to a distance between the detecting line L1 and the writing start position of the imaging bar. So, it is possible to obtain the write start position of the imaging bar to the detecting position P1 of the registration sensor 59 by sensing a distance between 2 points on the detecting line L1 by the registration sensor 59. Although the triangle ABC does not always become a right-angled isosceles equilateral triangle with the vertex B, it is sufficient if the triangle is nearly a right-angled triangle.

Figure 9B:
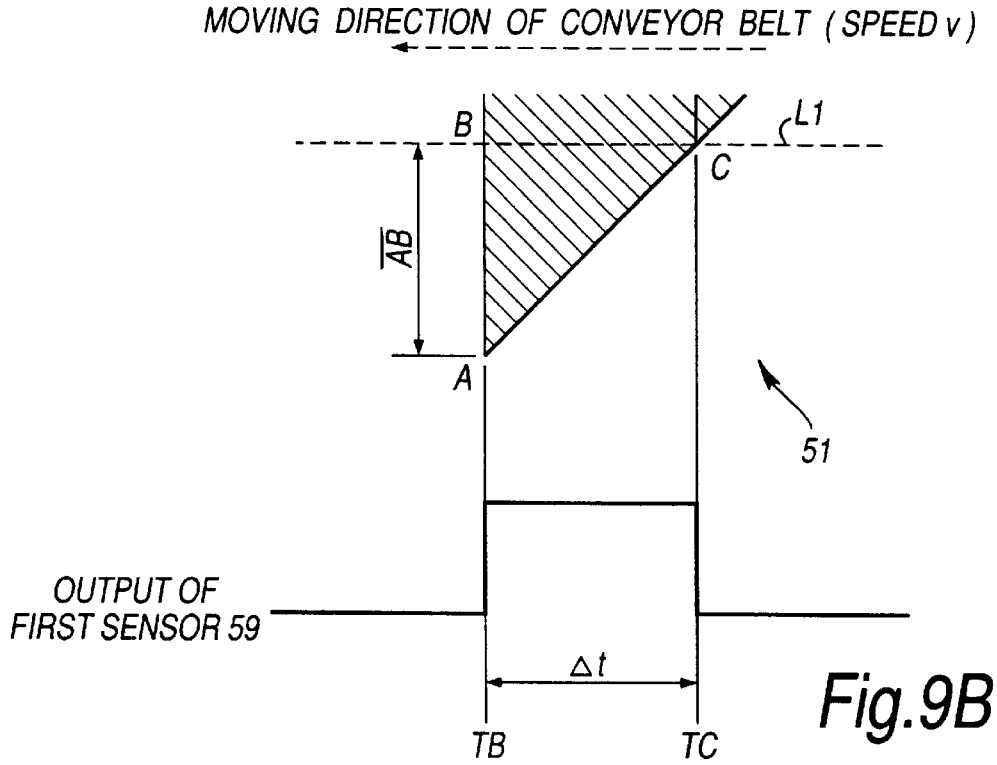

FIG. 9B shows a test pattern image that is in the same shape as that shown in FIG. 9A but is comprised of an image with the inside enclosed by the sides AB and CA smeared out in black. This test pattern image is detected as a rectangular pulse signal over $\Delta t$ on the first registration sensor 59.

By the width of this pulse signal, it is possible to detect a deviation in the main scanning direction according to the same method as shown in FIG. 9A. That is, it is possible to detect the write start position of the imaging bar to the detecting position P1 of the first registration sensor 59.

Figure 9C:
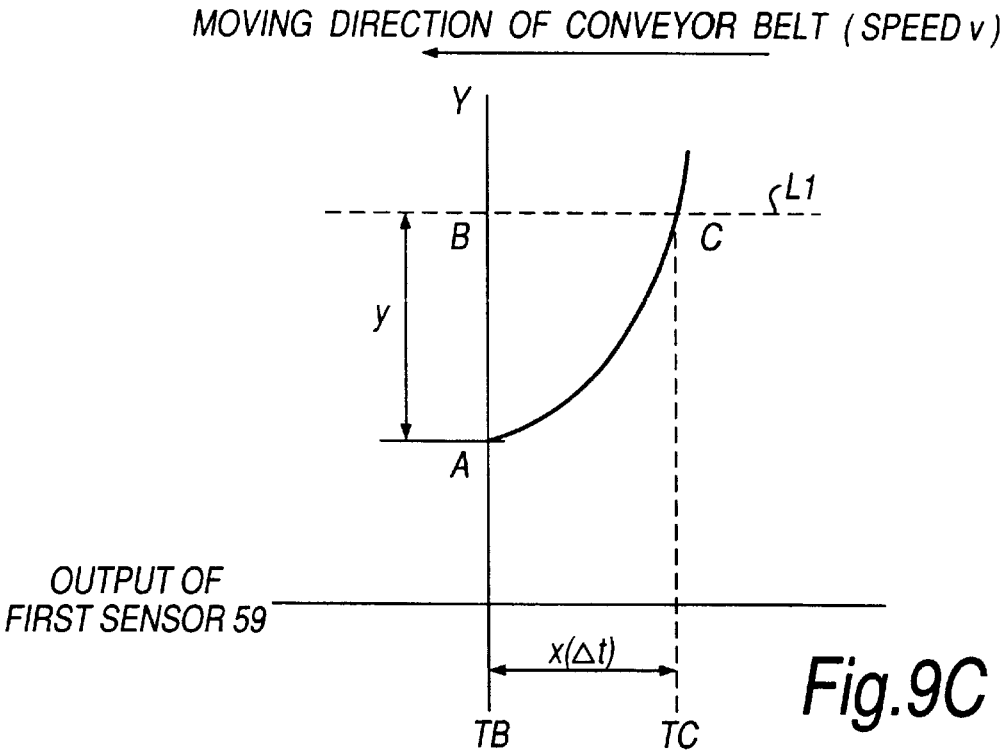

In FIGS. 9A and 9B, it was made to detect the 2 straight lines or the straight-lines edges but they are not necessarily the straight lines or the straight-line edges but a straight line (Y-axis) and a secondary curve shown in FIG. 9C may be sufficient. If the curve has such a relative equation of $y=x^2$ ($x \geqq 0$), it is possible to detect a deviation of the main scanning direction similarly to FIG. 9A according to the relative equation $y=x^2$ by sensing the passing the Y-axis and the second curve, that is, sensing length of x by the first registration sensor 59. That is, it is possible to obtain the write start position of the imaging bar to the detecting position P1 of the first registration sensor 59.

Figure 9D:
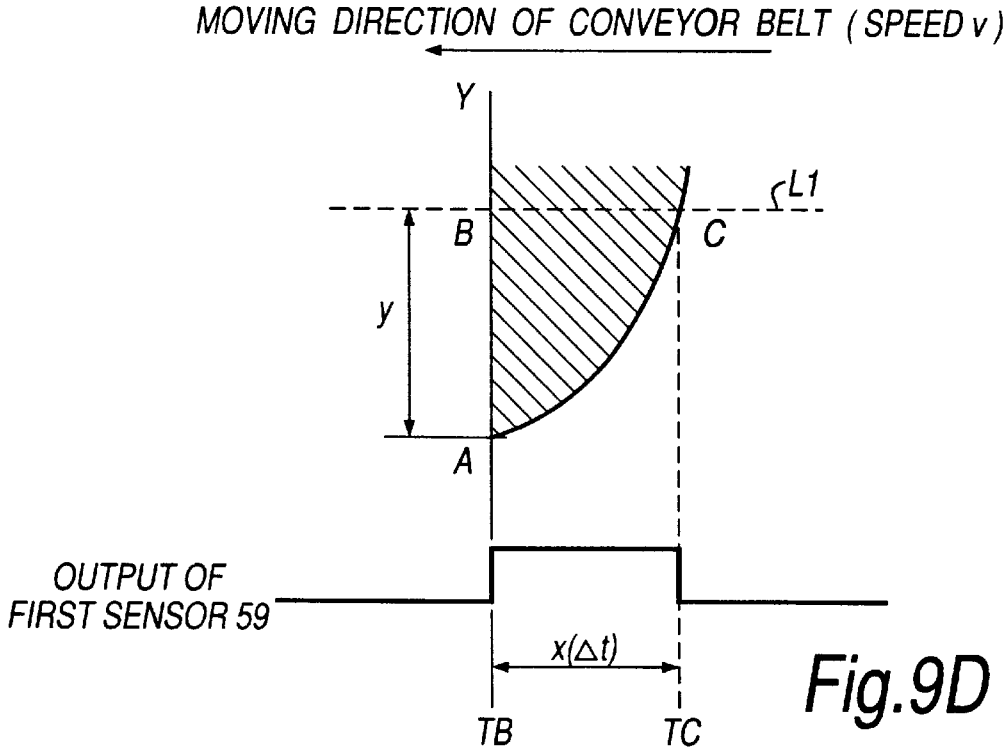

FIG. 9D shows a test pattern image comprising an image with the inside enclosed by the Y-axis and the second curve shown in FIG. 9C smeared out in black. This test pattern image is detected as a rectangular pulse signal over $\Delta t$ by the first registration sensor 59. It is possible to detect a deviation in the main scanning direction in the same manner as the method shown in FIG. 9A by computing the length from the width of this signal. That is, it is possible to obtain the write start position of the imaging bar to the detecting position P1 of the first registration sensor 59.

In FIG. 9C and 9D, it was made to detect one straight line or a straight-lined edge and one curve or a curved edge by the first registration sensor 59.

Figure 9E:
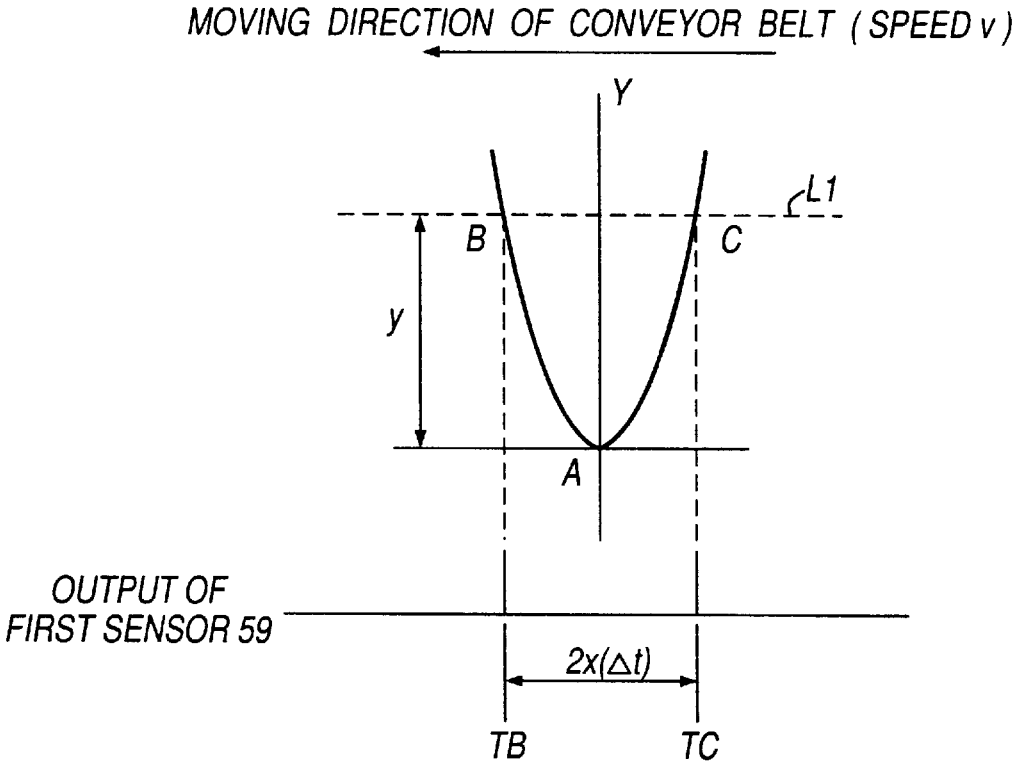

However, both of them may be secondary curves comprising curves as shown in FIG. 9E. That is, it may be a test pattern image in a shape enclosed by a secondary curve which have a relative equation $y=x^2$.

This test pattern image is detected as two pulse signals by the first registration sensor 59. It is possible to detect a deviation in the main scanning direction in the same manner as the method shown in FIG. 9A by computing 2x from an interval $\Delta t$ of the two pulse signals. That is, it is possible to obtain the write start position of the imaging bar to the detecting position P1 of the first registration sensor 59.

Although not shown, it may be a test pattern image with the inside enclosed by the second curve smeared out in black, having the relative equation $y=x^2$ shown in FIG. 9E. The second curve having the relative equation $y=x^2$ is apparently a single curve but is defined to be 2 curves combined to a single curve for convenience.

Therefore, like the test pattern images shown in FIGS. 9A through 9E, a test pattern image may be in a shape that at least a pair of lines or edges which have a specified relationship are detected.

Figure 10:
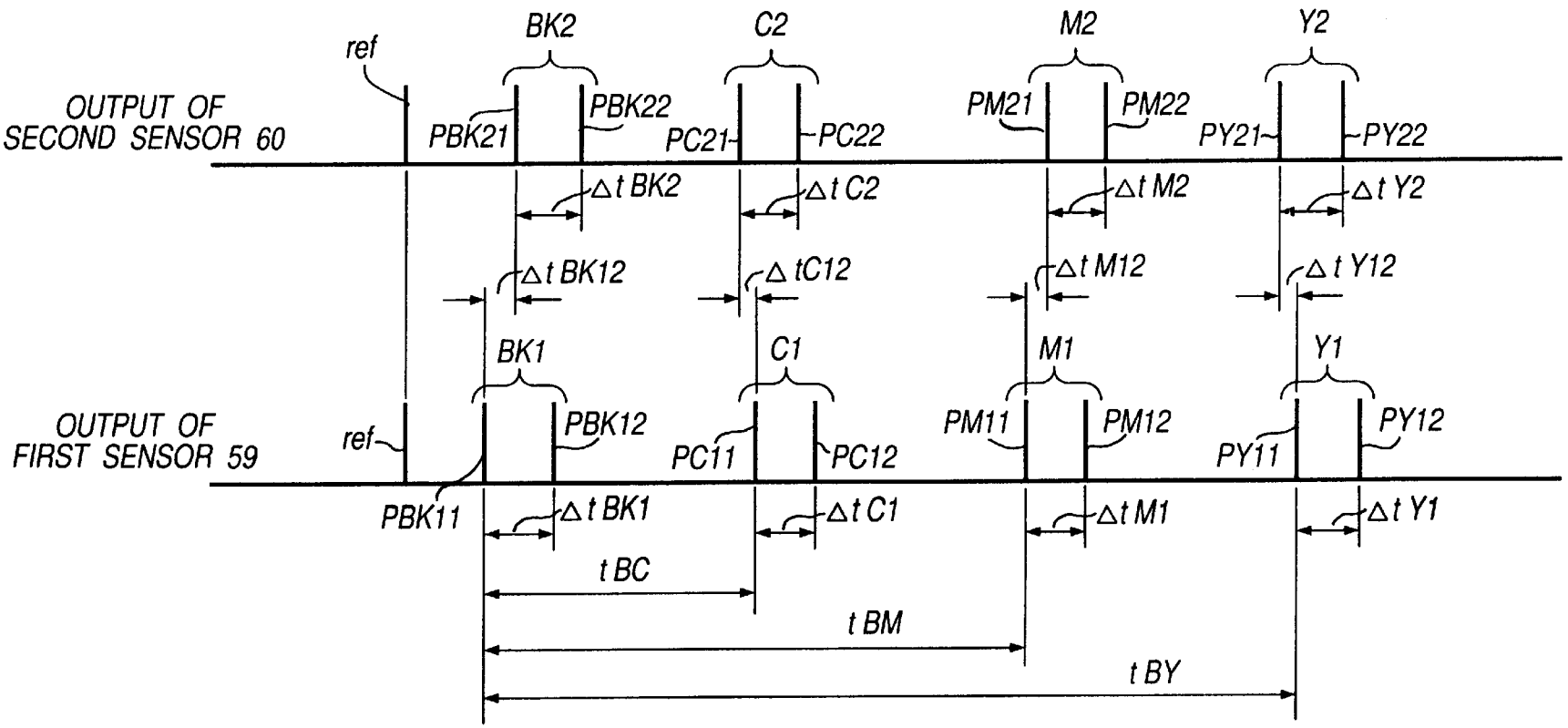
FIG. 10 is a timing chart showing one example of the output of a first and a second registration sensors, which is obtained from the positional relationship between the deviation detecting mechanism and a test pattern image formed on the conveyer belt.

FIG. 10 shows output signals of the first and the second registration sensors 59 and 60. FIG. 10 corresponds to a case where the first and the second registration sensors 59 and 60 shown in FIG. 6 were arranged substantially on the same line and the pulse output timings of the registration sensors 59 and 60 to the passage of the reference line "ref" formed on the conveyer belt 51 are the same.

Hereinafter, referring to a timing chart shown in FIG. 10 and a flowchart in FIG. 14, a method will be explained to detect and correct tilt of the imaging bar against the photosensitive drum in one of or all of the image forming units 10, 20, 30 and 40 or a tilt deviation generated from the image forming unit being tilted against the conveyer belt although the imaging bar is in parallel with the photosensitive drum.

The CPU 101 controls the test pattern data generator 200 to send out test pattern data to the imaging bars 13, 23, 33 and 43. As shown in FIG. 14, the first through the fourth test pattern images BK1 and BK2, C1 and C2, M1 and M2, and Y1 and Y2 are first formed on different places of the conveyer belt 51 at the same time along the detecting lines L1 and L2 of the conveyer belt 51 by the image forming units 10, 20, 30 and 40 (STP141).

Then, when these test pattern images pass the sensing points of both registration sensors, two pulse signals are output from both registration sensors every passage of respective test pattern images. For instance, when the test pattern BK1 shown in FIG. 6 passes the sensing point P1 of the registration sensor 59, the pulse signals PBK11 and PBK12 shown in FIG. 10 are output from the registration sensor 59. At the same time, when the test pattern BK2 shown in FIG. 6 passes the passing point P2 of the registration sensor 60, the pulse signals PBK21 and PBK22 shown in FIG. 10 are output from the registration sensor 60.

Similarly in other color test pattern images, when test pattern images C1, M1 and Y1 pass, pulse signals PC11 and PC12, PM11 and PM12, and PY11 and PY12 are output from the registration sensor 59. When the test pattern images C2, M2 and Y2 pass, pulse signals PC21 and PC22, PM21 and PM22, and PY21 and PY22 are output from the registration sensor 60.

The image data controller 111 measures an output time difference ΔtBK12 between PBK11 and PBK21, an output time difference ΔtC12 between PC11 and PC21, an output time difference ΔtM12 between PM11 and PM21, and an output time difference ΔtY12 between PY11 and PY21, respectively out of pulse signals output for the test pattern images in respective colors in order to detect the tilt of the image forming units (STP142).

Then, based on this information, the CPU 101 computes an angle of tilt of each color and send the computed result to the image data controller 111 (STP143).

That is, as a distance between the first and the second registration sensors 59 and 60 in the main scanning direction is G1, assuming that a tilt from an ideal position (a position in parallel with the reference line "ref") of the image forming unit 40 including the imaging bar 43 and the photosensitive drum 41 is θBK, tanθBK is expressed by $$\tan\theta BK = v\Delta tBK12/G1$$

Thus, a tilt angle θBK is obtained from the following equation:

$$\theta BK = \tan^{-1}(v\Delta tBK12/G1)$$

Further, a tilt when a test pattern image at the side corresponding to the second registration sensor 60 is delayed based on a test pattern image at the side corresponding to the first registration sensor 59 is regarded as "Positive" here.

A tilt tanθC in the photosensitive drum 31 and the imaging bar 33 of the third image forming unit 30, that is, the cyan C unit is shown by $$\tan\theta C = v\Delta tC12/G1$$

Thus, a tilt angle θC is obtained from the following equation:

$$\theta C = \tan^{-1}(v\Delta tC12/G1)$$

The tilt tanθC is "Negative" as shown in FIG. 10.

Similarly, a tilt tanθM in the photosensitive drum 21 and the imaging bar 23 of the second image forming unit 20, that is the magenta M unit is shown by $$\tan\theta M = v\Delta tM12/G1$$

and a tilt tanθY in the photosensitive drum 11 and the imaging bar 13 of the first image forming unit 10, that is, the yellow Y unit is shown by $$\tan\theta Y = v\Delta tY12/G1$$

The tilt tanθY is "Negative" as shown in FIG. 10.

Accordingly, the tilt angles θM and θY are shown by the following equations, respectively:

$$\theta M = \tan^{-1}(v\Delta tM12/G1)$$

and $$\theta Y = \tan^{-1}(v\Delta tY12/G1)$$

Based on the respective tilt angles θBK, θC, θM and θY of the first through the fourth image forming units 10, 20, 30 and 40 thus obtained in STP 143, the amount of image data for revolution process for one line by the image revolution processors 213, 223, 233 and 243 of the image data control circuit 112 are set up. Further, the tilt angles θBK, θC, θM and θY thus obtained are stored in the NVM 104 (STP144).

Figure 14:
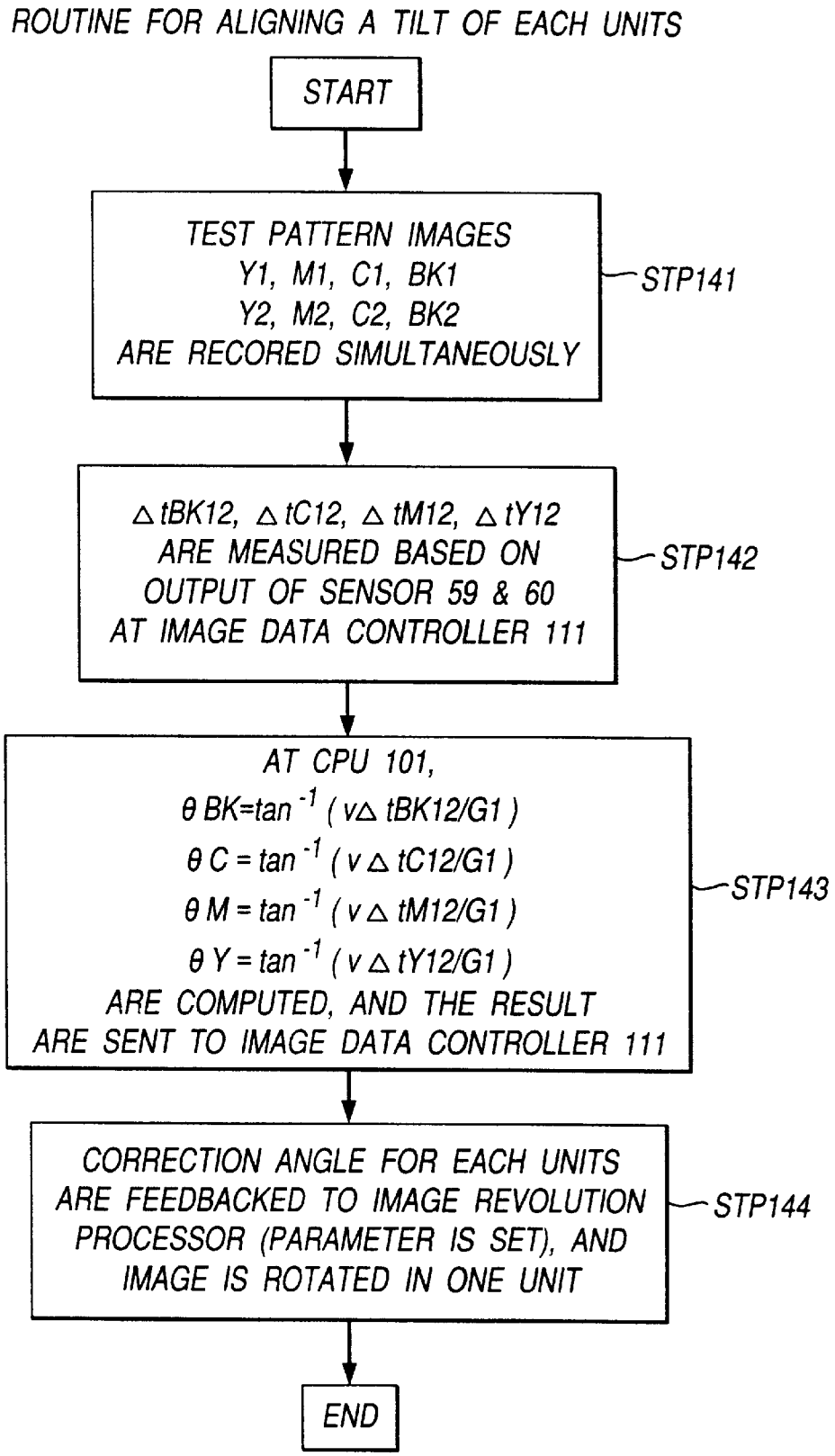
FIG. 14 is a flowchart showing a method to detect a tilted deviation from the positional relationship between the deviation detecting mechanism and a test pattern image formed on the conveyer belt shown in FIG. 6.
Figure 15:
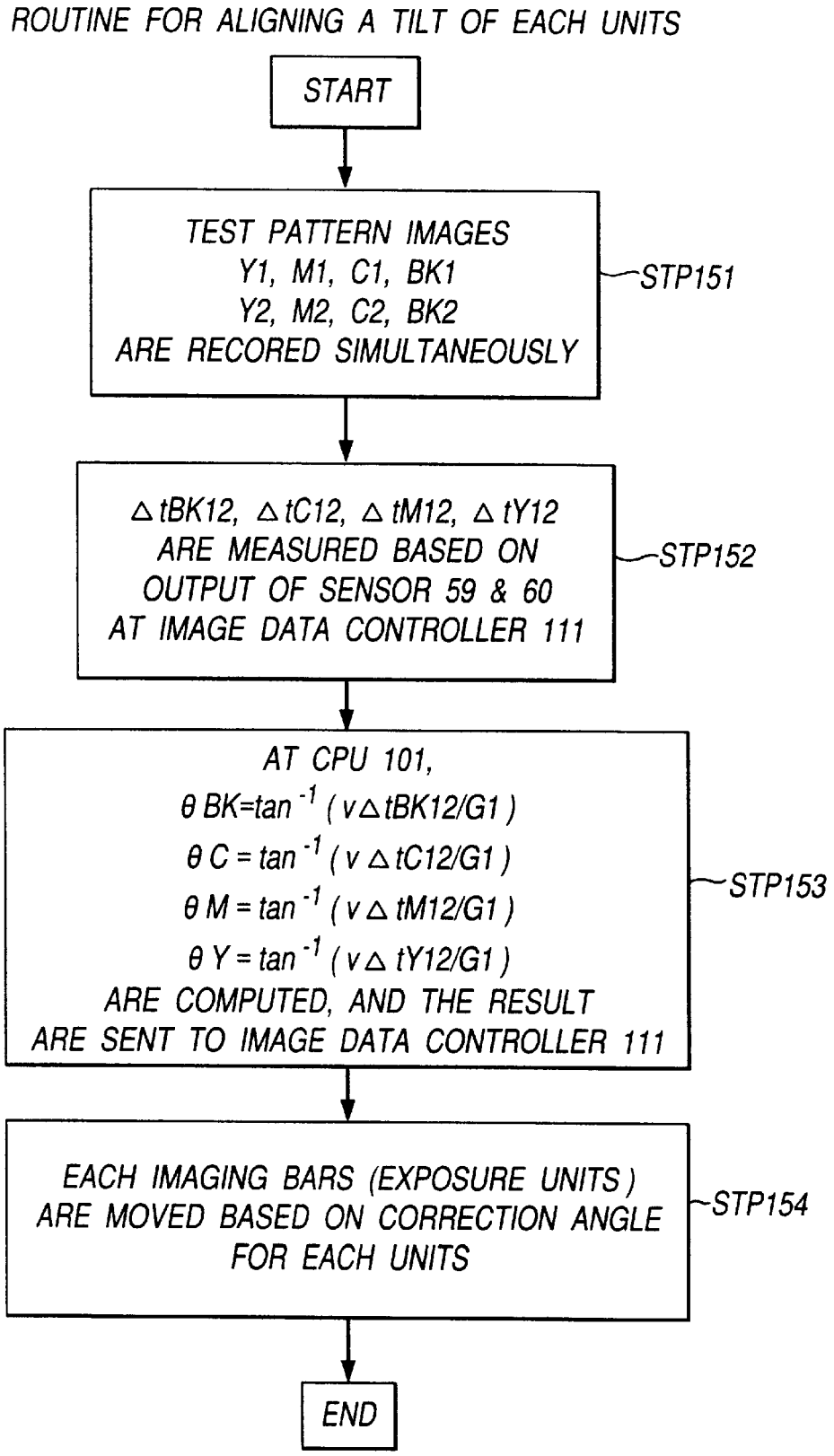
FIG. 15 is a flowchart showing a deformed example of the method to detect the tilted deviation shown in FIG. 14.
Figure 21:
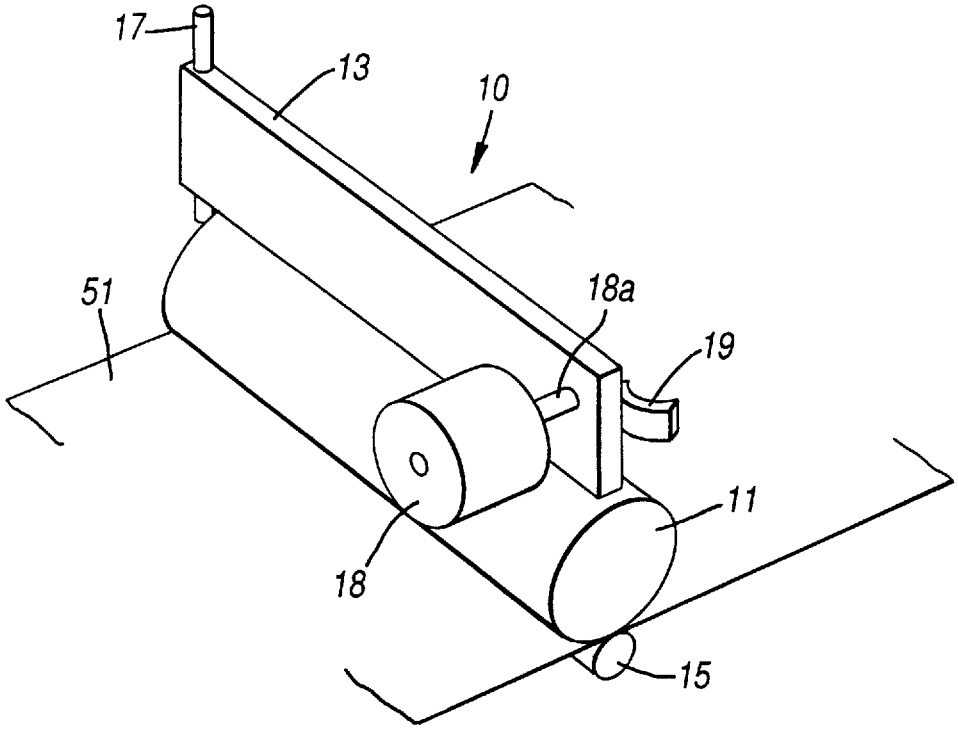
FIG. 21 is a schematic perspective view showing one example of a tilted deviation removing mechanism which is incorporated in the image forming apparatus shown in FIG. 1.

Instead of the image data revolution process shown in FIG. 14, the imaging bars (the exposure units) may be moved by a tilt deviation removing mechanism shown in FIG. 21 so that the tilt angle of each imaging bar obtained according to the method described above becomes 0 degree as shown in FIG. 15 (STP 154). The explanation of STP151–STP153 will be omitted as they are the same as STP141–STP143 shown in FIG. 14.

Figure 16:
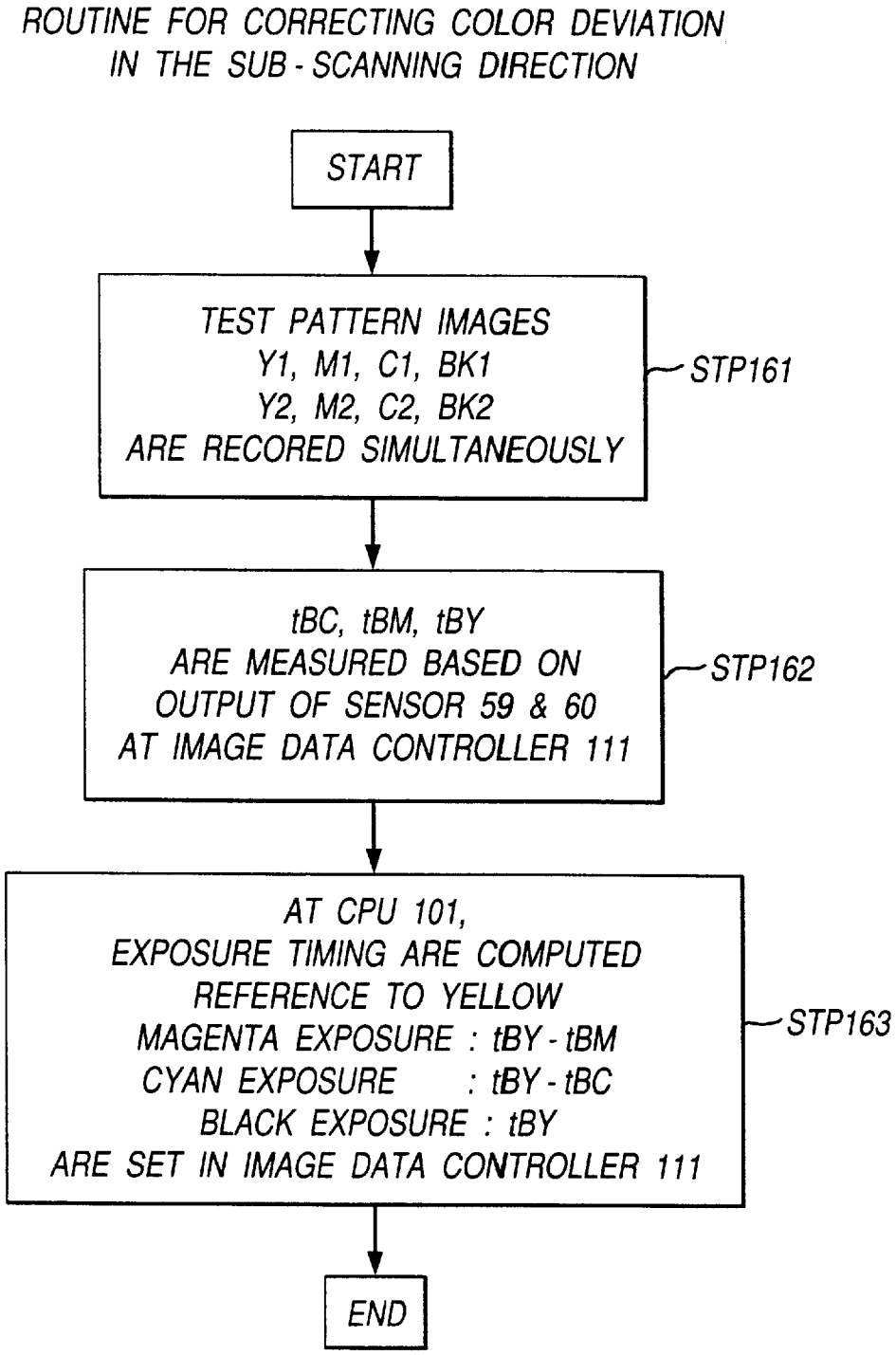
FIG. 16 is a flowchart showing a method to detect a deviation in the sub-scanning direction from the positional relationship between the deviation detecting mechanism and a test pattern image formed on the conveyer belt shown in FIG. 6.

Hereafter, referring to the timing chart shown in FIG. 10 and the flowchart shown in FIG. 16, a method will be explained to detect and correct deviations in the sub-scanning direction generated from different spaces among the image forming units 10, 20, 30 and 40.

First, the first through the fourth test pattern images BK1 and BK2, C1 and C2, M1 and M2, and Y1 and Y2 are formed simultaneously on different places of the conveyer belt 51 along the detecting lines L1 and L2 by the image forming units 10, 20, 30 and 40 (STP161). As explained in the above using FIG. 10, when the test pattern images BK1 and BK2 formed by the fourth image forming unit 40 pass the sensing points P1 and P2 following the output corresponding to the reference line "ref" formed on the conveyer belt 51, the pulse signals PBK11, PBK12, PBK21 and PBK22 corresponding to the test pattern images BK1 and BK2 are output. Further, by the third image forming units 30, the second image forming unit 20 and the first image forming unit 10, the test pattern images C1 and C2, M1 and M2, and Y1 and Y2 pass the detecting positions P1 and P2 by the first and the second registration sensor 59 and 60.

As a result, the pulse signals PC11, PC12, PC21 and PC22 corresponding to the test pattern images C1 and C2, the pulse signals PM11, PM12 PM21 and PM22 corresponding to the test pattern images M1 and M2, and the pulse signals PY11, PY12, PY21 and PY22 corresponding to the test pattern images Y1 and Y2 are output in order.

Here, the test pattern image groups (here, obtained by the first registration sensor 59) BK1, C1, M1 and Y1 that are formed along either the detecting line L1 or L2 out of the output of the first and the second registration sensor 59 and 60 are noticed. A time difference between the edge of the black image and that of the cyan image is expressed by tBC, a time difference between the edge of the black image and that of the magenta image is expressed by tBM, and a time difference between the edge of the black image and that of the yellow image is expressed by tBY (STP162). As to the correction of a deviation in this sub-scanning direction, it is affected by the tilt correction described above and therefore, it is necessary to correct a deviation in the sub-scanning direction after performing the tilt correction or when performing both corrections simultaneously, it is necessary to take a revolving angle of images by the tilt correction into consideration.

Therefore, the exposure timings of magenta image, cyan image and black image can be defined as shown below based on the exposure timing of the yellow image:

Exposure timing of magenta image→tBY−tBM

Exposure timing of cyan image→tBY−tBC, and

Exposure timing of black image→tBY

As described above, the exposure timings of the yellow, magenta, cyan and black image forming units 10, 20, 30 and 40 are computed by the CPU 101 and timings to send out image data from page memories 113, 123, 133 and 143 of the image data controller 112 are set in the image data controller 111. Further, respective image data sending timings are stored in the NVM 104.

Next, referring to the test pattern image shown in FIG. 11 and the flowchart shown in FIG. 17, a method will be explained to detect and correct the main scanning deviation generated from a deviation in the mounting position of the image forming units 10, 20, 30 and 40 in the main scanning direction or the position of the light source in the single imaging bar. The test pattern image shown in FIG. 11 corresponds to the timing chart shown in FIG. 10.

Figure 17:
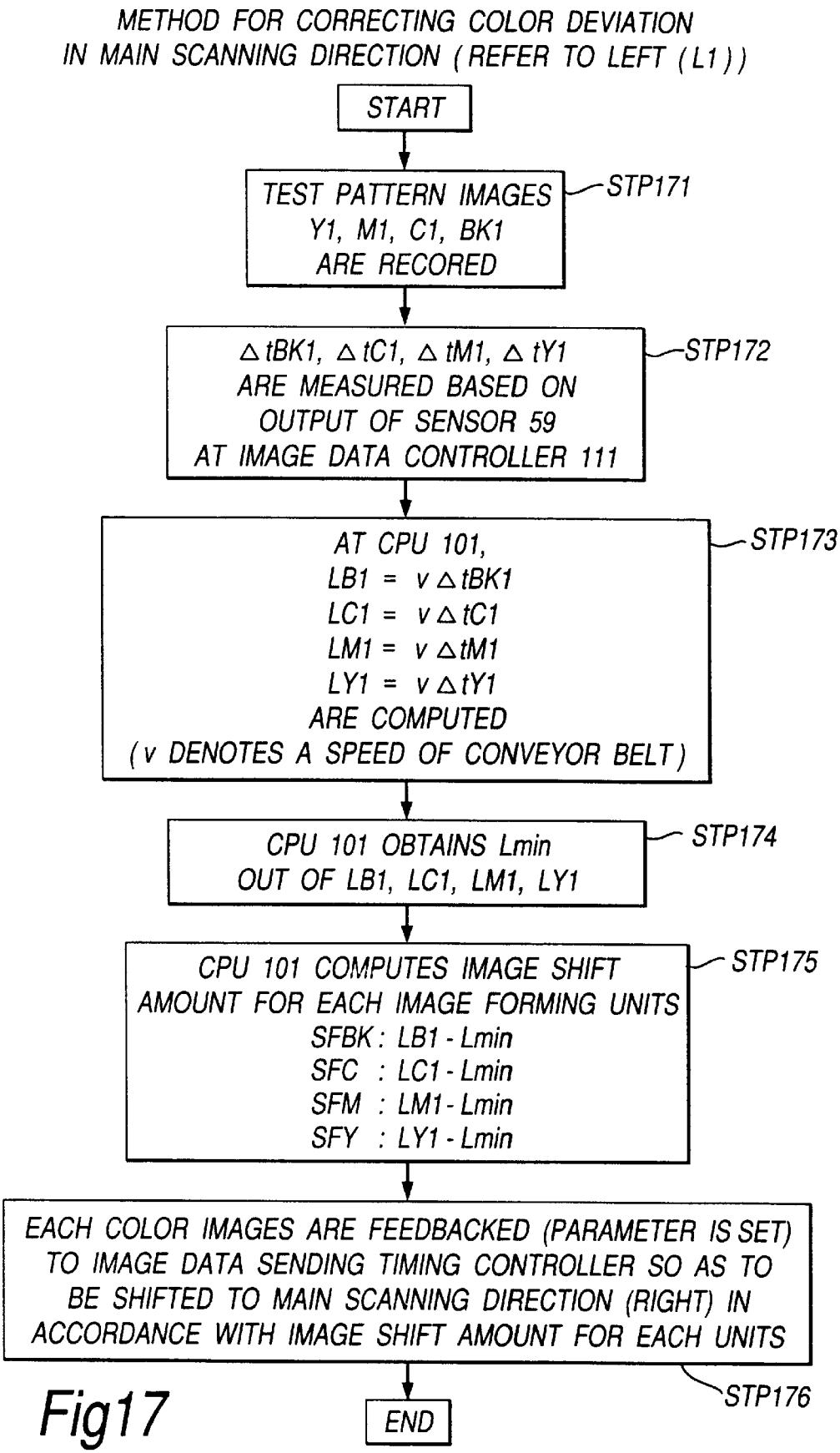
FIG. 17 is a flowchart showing a method to detect a deviation in the main scanning direction from the positional relationship between the deviation detecting mechanism and a test pattern image formed on the conveyer belt shown in FIG. 6.

First, test pattern images in respective colors are recorded as shown in the flowchart in FIG. 17 (STP171).

Then, ΔtBK1, ΔtC1, ΔtM1 and ΔtY1 shown in FIG. 10 are measured by the image data controller 111 based on the output of the first registration sensor 59 (STP172).

Figure 11:
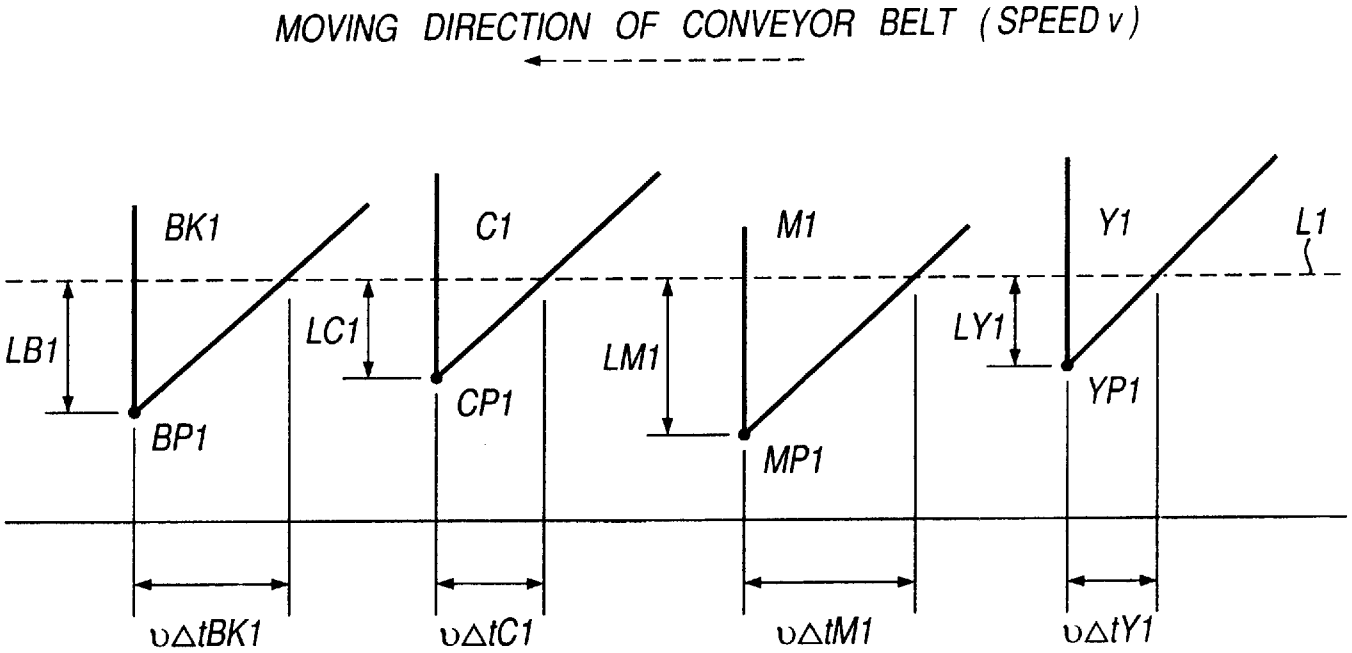
FIG. 11 s a schematic diagram showing the principle that the deviation in the main scanning direction can be detected by the deviation detecting mechanism shown in FIG. 2.

As shown in FIG. 11, the intervals ΔtBK1, ΔtC1, ΔtM1 and ΔtY1 between two pulses output according to the test pattern images BK1, C1, M1 and Y1 passing the detecting position P1 of the first registration sensor 59 25 arranged corresponding to the detecting line L1 are replaced by the detecting line L1 and the write position of the first straight line 1L of respective test pattern images as explained using FIG. 9.

That is, the lengths LB1, LC1, LM1 and LY1 from the end of the first straight line 1L (designated BP1, CP1, MP1 and YP1) to the detecting line L1 of the test pattern images formed by the image forming units are expressed as shown below:

LB1=vΔtBK1,

LC1=vΔtC1,

LM1=vΔtM1, and

LY1=vΔtY1

This computation is made by the CPU 101 (STP173).

Then, likewise the above, the minimum length Lmin out of the lengths of the first lines LB1, LC1, LM1 and LY1 obtained as described above is obtained (STP174).

In succession, based on this Lmin, the first positions of image data to be supplied to the light sources of respective imaging bars, that is, shift volume of image data SFBK, SFC, SFM and SFY are defined as shown below (STP175):

SFBK→LB1−Lmin,

SFC→LC1−Lmin,

SFM→LM1−Lmin, and

SFY→LY1−Lmin

Thus, shift data of image data to be supplied to respective imaging bars of the yellow, magenta, cyan and black image forming units 10, 20, 30 and 40 are computed by the CPU 101. Then, the CPU 101 supplies this shift data of image data to image shift processors 413, 423, 433 and 443 of the image data control circuit 112 for setting amounts of shifting image data. Further, the shift data of respective image data are stored in the NVM 104 (STP176).

Next, referring to the test pattern image shown in FIG. 12 and the flowchart shown in FIG. 18, a method will be explained to detect and correct a deviation among the light sources in the manufacturing process of the imaging bars in the image forming units 10, 20, 30 and 40 or a main scanning magnification factor error which may be generated when the recording system is a laser beam system as shown in FIGURE 22. The test pattern image shown in FIG. 12 corresponds to the timing chart shown in FIG. 10.

First, the test pattern images Y1, M1, C1 and BK1 and Y2, M2, C2 and BK2 are recorded on the conveyer belt 51 (STP181).

Then, ΔtBK1, ΔtC1, ΔtM1, ΔtY1, ΔtBK2, ΔtC2, ΔtM2 and ΔtY2 shown in FIG. 10 are measured by the image data controller 111 based on the outputs from the first and the second registration sensors 59 and 60 (STP182).

Figure 12:
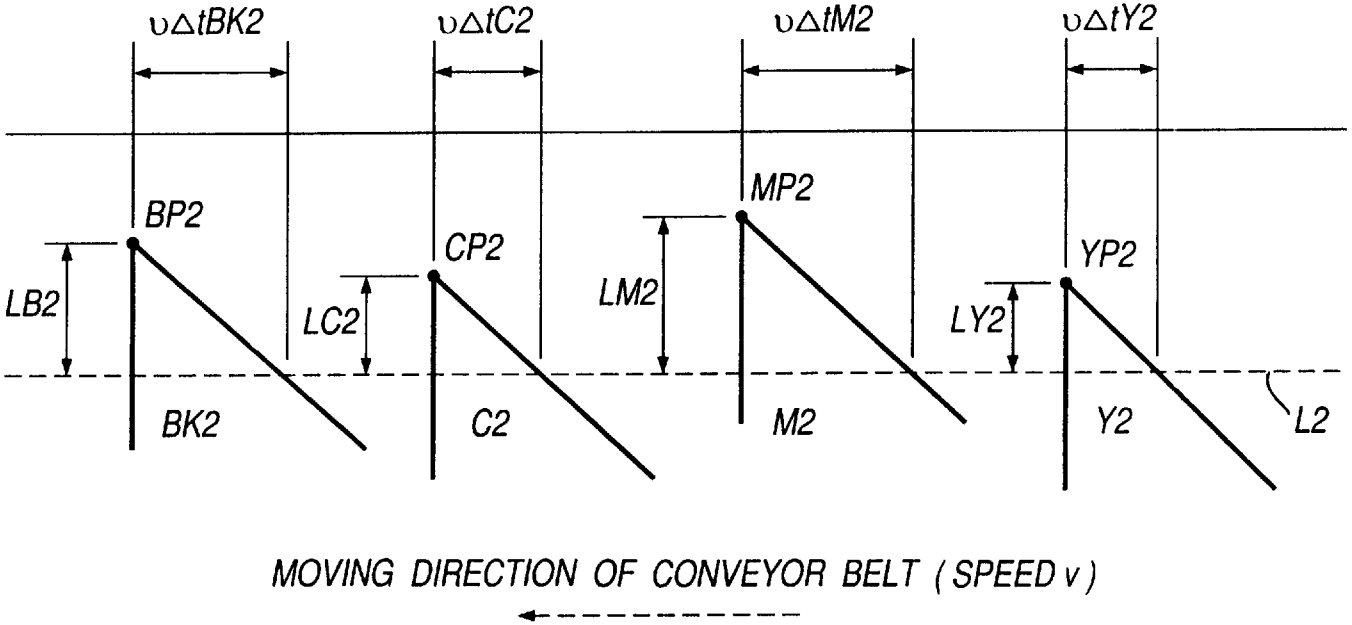
FIG. 12 is a schematic diagram showing the principle that a magnification error can be detected by the deviation detecting mechanism shown in FIG. 2.

In the similar manner as explained in FIG. 11, intervals ΔtBK2, ΔtC2, ΔtM2 and ΔtY2 between two pulses output by the test pattern images BK2, C2, M2 and Y2 which pass the detecting position P2 of the second registration sensor 60 arranged corresponding to the detecting line L2 shown in FIG. 12 are replaced by the detecting line L2 and the write position of the first straight line 1L' of respective test pattern images as already explained using FIGS. 8 and 9.

That is, the lengths LB2, LC2, LM2 and LY2 from the end of the first straight line 1L' (designated BP2, CP2, MP2 and YP2) of the test pattern images supplied by respective image forming units to the detecting line L2 are expressed as shown below:

LB2=vΔtBK2,

LC2=vΔtC2,

LM2=vΔtM2, and

LY2=vΔtY2

This computation and the computation regarding LB1, LC1, LM1 and LY1 previously explained in FIGS. 11 and 17 are performed by the CPU 101 (STP183).

Then, distances between LB2, LC2, LM2 and LY2 obtained as described above and LB1, LC1, LM1 and LY1 shown in FIG. 11, that is, the widths W of the test pattern images (hereinafter referred to as write widths) formed by the image forming units are obtained.

Here, as the space in the main scanning direction between the first and the second registration sensors 59 and 60 is shown by G1 as already explained using FIG. 6, respective write widths WBK, WC, WM and WY of the image forming units 10, 20, 30 and 40 are defined by

WBK→LB1+G1+LB2,

WC→LC1+G1+LC2,

WM→LM1+GI+LM2, and

WY→LY1+G1+LY2

This computation is performed by the CPU 101 (STP184).

Then, the minimum write width Wmin out of the write widths WBK, WC, WM and WY obtained as described above is obtained by the CPU 101 (STP185).

In succession, to give a specified magnification to image data when writing them so that lengths of image data corresponding to respective colors that are written on corresponding photosensitive drums, that is, the write widths become substantially the same based on the Wmin, magnifications DMBK, DMC, DMM and DMY to respective image data are defined as follows:

DMBK→Wmin/WBK,

DMC→Wmin/WC,

DMM→Wmin/WM, and

DMY→Wmin/WY

This computation is made by the CPU 101 (STP186).

Thus, correcting magnification factors corresponding to respective image data of the yellow, magenta, cyan and black image forming units 10, 20, 30 and 40 are computed by the CPU 101. This correction magnification factors are supplied to the image data controller 111. The image data controller 111 transfers these correction magnification factors to the image expansion reduction processors 313, 323, 333 and 343 of the image data control circuit 112, where image expansion/reduction magnification factors are set. Further, the correction magnification factors to be supplied to respective image data are stored in the NVM 104 (STP187).

Figure 23A:
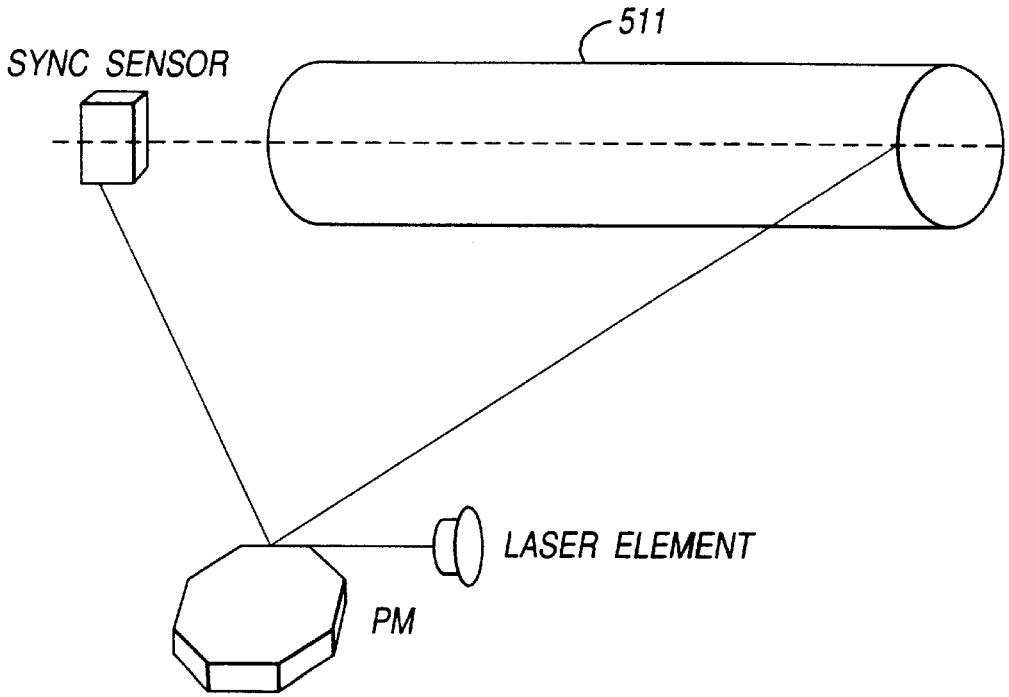
FIGS. 23A and 23B are a perspective view and a schematic top view showing the printing area which changes according to the deviation of the mounting positions of the photosensitive drums.
Figure 23B:
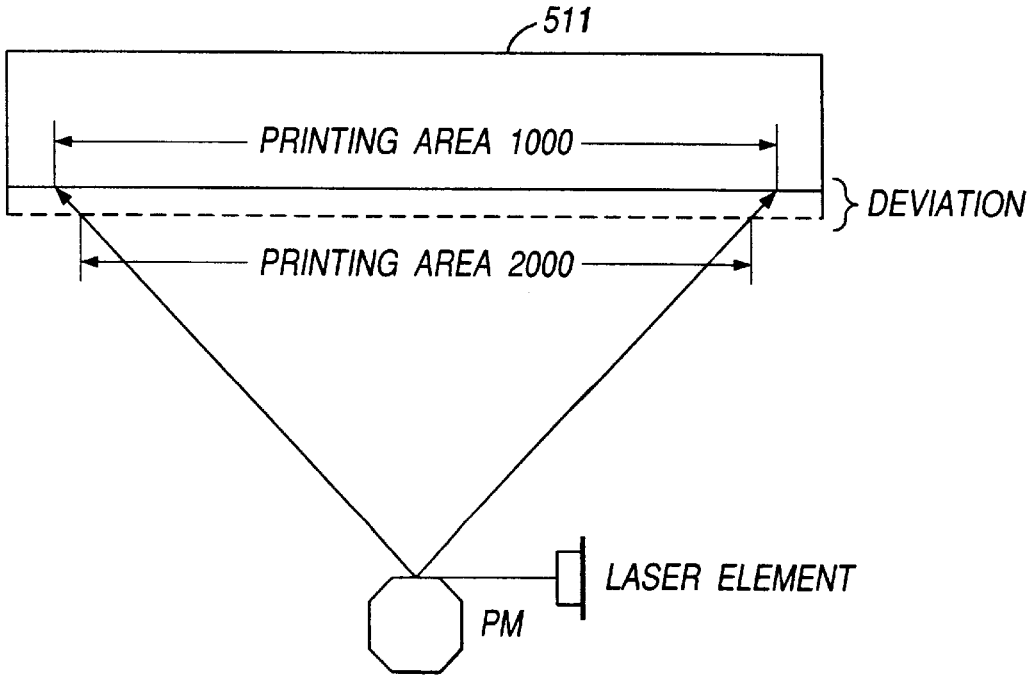

Errors in the photosensitive drum mounting position, that is, the state where an image magnification factor is changed by the change in distances between the photosensitive drums and the optical scanning unit is shown in FIGS. 23A and 23B. That is, when a photosensitive drum 511 has been arranged at the position shown by the dotted line offset from the proper position while a correct printing area 1000 is scanned by a polygonal mirror PM, the area reduced so that it is shown as a printing area 2000 is scanned by the polygonal mirror PM. In this case, the reduced area is expanded by the image expansion reduction processors 313, 323, 333 and 343 based on the correction magnification factor.

In the following, a method will be explained for correcting sensor outputs similar to tilt deviations resulting from the first and the second registration sensors 59 and 60, which are generated when the first and the second registration sensors 59 and 60 are not preset on the same straight line in the main scanning direction as show in FIG. 7. Further, as accuracy demanded when fixing the first and the second registration sensors 59 and 60 is sharply relieved by this method, it becomes possible to reduce manufacturing cost of an image forming apparatus sharply.

Figure 13:
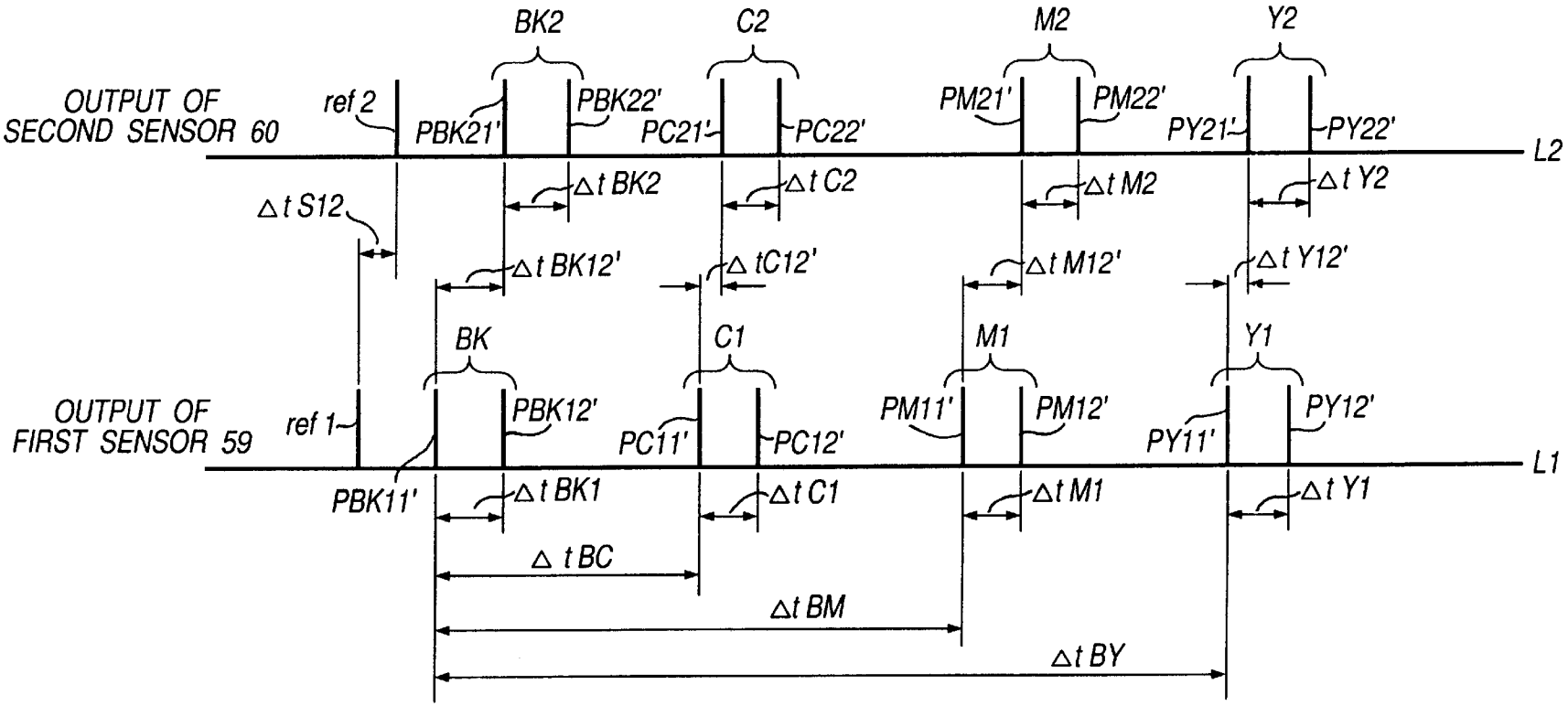
FIG. 13 is a timing chart showing one example of the output of the first and the second registration sensors, which is obtained from the positional relationship between the deviation detecting mechanism and a test pattern image formed on the conveyer belt shown in FIG. 7.

Similarly as explained above using FIGS. 6 and 10, when the first and the second registration sensors 59 and 60 are arranged at the detecting positions P1 and P2 for the first and the second detecting lines L1 and L2 of the conveyer belt 51, it is possible to make the similar process by replacing the detecting positions P1 and P2 with P1' and P2' in FIG. 7. So, when the detecting positions of the first and the second registration sensors 59 and 60 are arranged at P1' and P2' as shown in FIG. 7, such a timing chart as shown in FIG. 13 is obtained. The output of the reference line "ref" in FIG. 13 is an example when the detecting position P1' is shifted to the image forming unit side more than the detecting position P2' and therefore, the output of the first registration sensor 59 at the detecting position P1' is output before the output of the second registration sensor 60 at the detecting position P2'.

Next, referring to the timing chart shown in FIG. 13 and the flowchart shown in FIG. 19, a method will be explained for sensing and correcting a tilt deviation resulting from the image forming units 10, 20, 30 and 40 being tilted against the conveyer belt 51 by the first and the second registration sensors 59 and 60 arranged at the positions which are shifted each other not on the same line along the main scanning direction.

In order to obtain a time difference ΔtS12 between the output pulses ref1 and ref2 of the first and the second registration sensor 59 and 60 for the reference line "ref", an input time difference of the output pulses of the first and the second registration sensors 59 and 60 which are input to the image data controller 111 is measured in the state where no test pattern image is formed on the conveyer belt 51 (STP191).

Next, the test pattern images Y1, M1, C1 and BK1, and Y2, M2, C2 and BK2 are recorded on the conveyer belt 51 by the image forming units 10, 20, 30 and 40 (STP192).

The test pattern images Y1, M1, C1 and BK1, and Y2, M2, C2 and BK2 formed on the conveyer belt 51 pass the detecting positions P1' and P2' of the first and the second registration sensors 59 and 60, respectively and both sensors 59 and 60 detect the test pattern images and output pulse signals, which are corresponding to respective test patterns, PBK11', PBK12', PC11', PC12', PM11', PM12', PY11' and PY12', and PBK21', PBK22', PC21', PC22', PM21', PM22', PY21' and PY22', respectively.

The image data controller 111 measures 4 times ΔtBK12' (a time difference between PBK11' and PBK21'), ΔtC12' (a time difference between PC11' and PC21'), ΔtM12' (a time difference between PM11' and PM21') and ΔtY12' (a time difference between PY11' and PY21') which are needed for tilt computation from these pulse signals (STP193).

As ΔtBK12', ΔtC12', ΔtM12' and ΔtY12' measured by the image data controller 111 contain a time ΔtS12 by the sensor mounting phase difference measured in STP191, the following computations for removing this time are performed by the CPU 101 (STP194):

$$\Delta tBK12=\Delta tBK12'-\Delta tS12,$$

$$\Delta tC12=\Delta tC12'-\Delta tS12,$$

$$\Delta tM12=\Delta tM12'-\Delta tS12, \text{ and}$$

$$\Delta tY12=\Delta tY12'-\Delta tS12$$

As ΔtBK12, ΔtC12, ΔtM12 and ΔtY12 obtained here can be treated likewise a case where there is no sensor mounting phase difference as explained in FIG. 10, tilt angles of the image forming units θBK, θC, θM and θY against the conveyer belt 51 are computed by the CPU 101 as shown below (STP195):

$$\theta BK=\tan^{-1}(v\Delta tBK12/G1),$$

$$\theta C=\tan^{-1}(v\Delta tC12/G1),$$

$\theta M = \tan^{-1}(v\Delta tM12/G1)$, and $\theta Y = \tan^{-1}(v\Delta tY12/G1)$ Thus, the tilt angles θBK, θC, θM and θY of the first through the fourth image forming units 10, 20, 30 and 40 are obtained by the CPU 101 and image data for revolution processed for one line by the image revolution processors 213, 223, 233 and 243 of the image data control circuit 112 are set in the image data controller 111. Further, the tilt angles θBK, θC, θM and θY thus obtained are stored in the NVM 104 (STP196).

Figure 19:
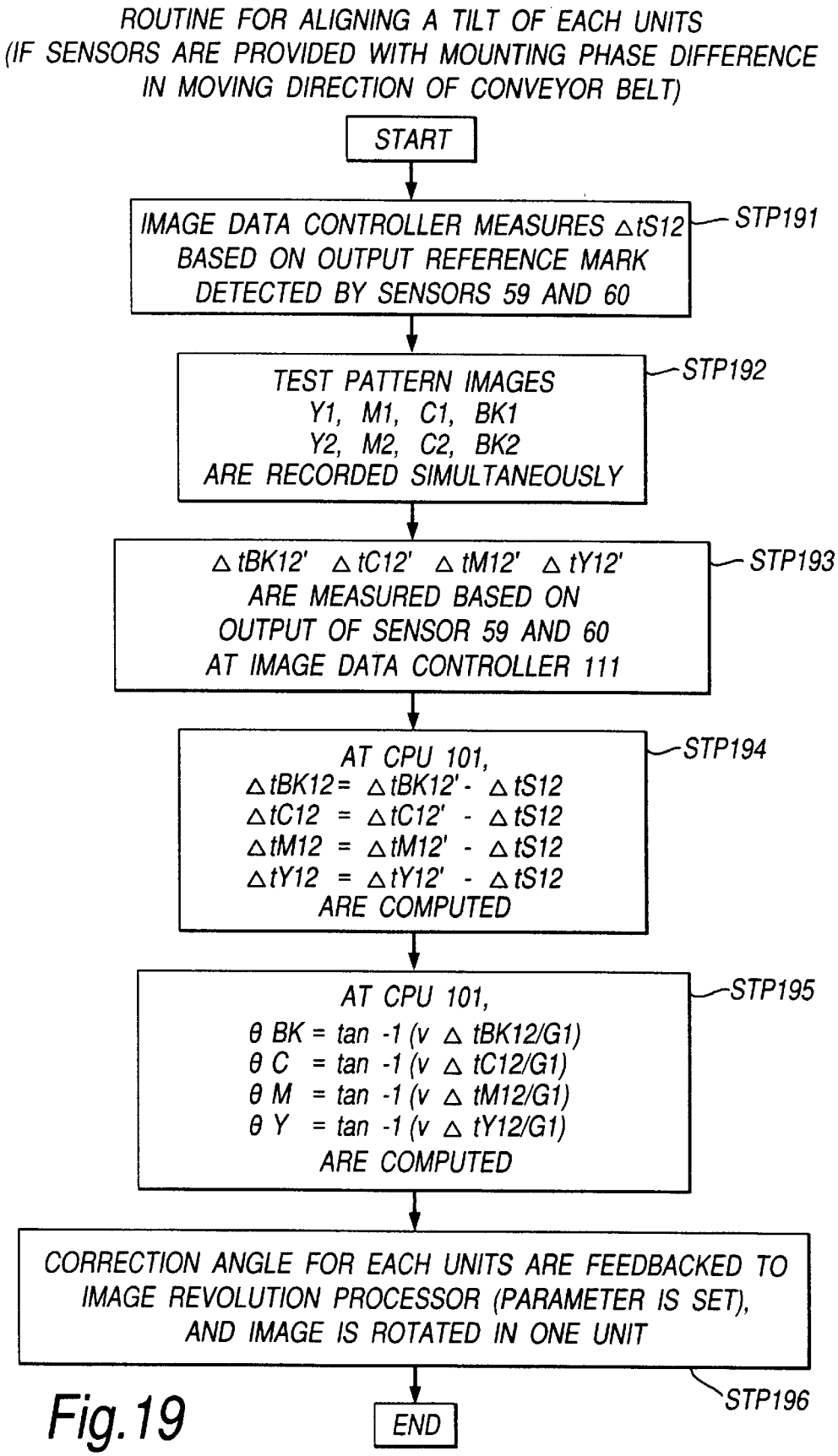
FIG. 19 is a flowchart showing a method to detect a tilted deviation from the positional relationship between the deviation detecting mechanism and a test pattern image formed on the conveyer belt shown in FIG. 7.

Further, instead of the revolution process of image data shown in FIG. 19, it may be allowed to change the mounting angles of the imaging bars in the image forming units so that the tilt angles of test pattern images recorded on the conveyer belt 51 become 0 degree as shown in FIG. 21 and the imaging bars are moved by the tilt deviation removing mechanism shown in FIG. 21 (STP206 and STP207). The explanation of the steps STP201 through STP205 will be omitted as they are the same as the steps STP191 through STP195.

FIG. 21 is a schematic diagram showing a tilt deviation removing mechanism incorporated in the imaging bars 13, 23, 33 and 43 of the image forming units 10, 20, 30 and 40.

Figure 20:
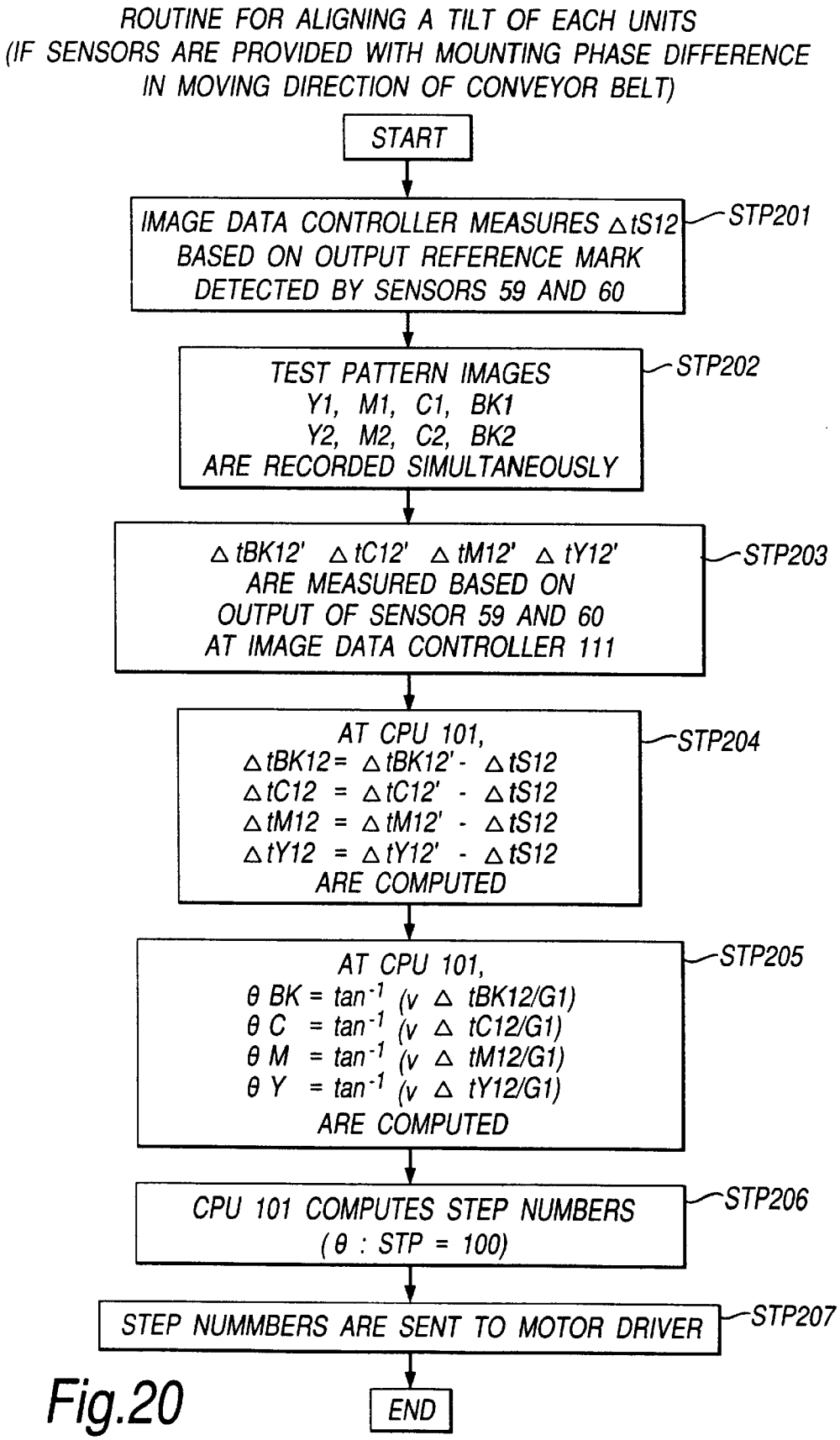
FIG. 20 is a flowchart showing a deformed example of the method to detect the tilted deviation shown in FIG. 19.

As shown in FIG. 21, a shaft 17 to support the imaging bar 13 movably in the direction orthogonal to the main scanning direction is formed at one end of the imaging bar 13 in the main scanning direction. At the end opposite side of the end where the shaft 17 of the imaging bar 13 is formed, there is a head motor (for instance, a stepping motor) 18 is arranged for moving the imaging bar 13 in the sub-scanning direction. The head motor 18 is turned clockwise or counterclockwise by a head motor driver 131 (shown in FIG. 4) by the number of steps corresponding to the tilt angle θ obtained in STP206 shown in FIG. 20. As a result, the imaging bar 13 is moved to a specified position orthogonal to the sub-scanning direction with the shaft 17 as a turning shaft (standard) by a spring blade 19 opposing a motor shaft 18*a* and the motor 18. As the imaging bar 13 is moved by 1 degree, for instance, at 100 steps (pps) and the number of steps corresponding to the tilt angle θ is obtained in the step STP206 shown in FIG. 20 are obtained by the image data controller 111 or the CPU 101, the imaging bar is moved by the motor so that the tilt angle of each imaging bar becomes 0 degree.

Figure 18:
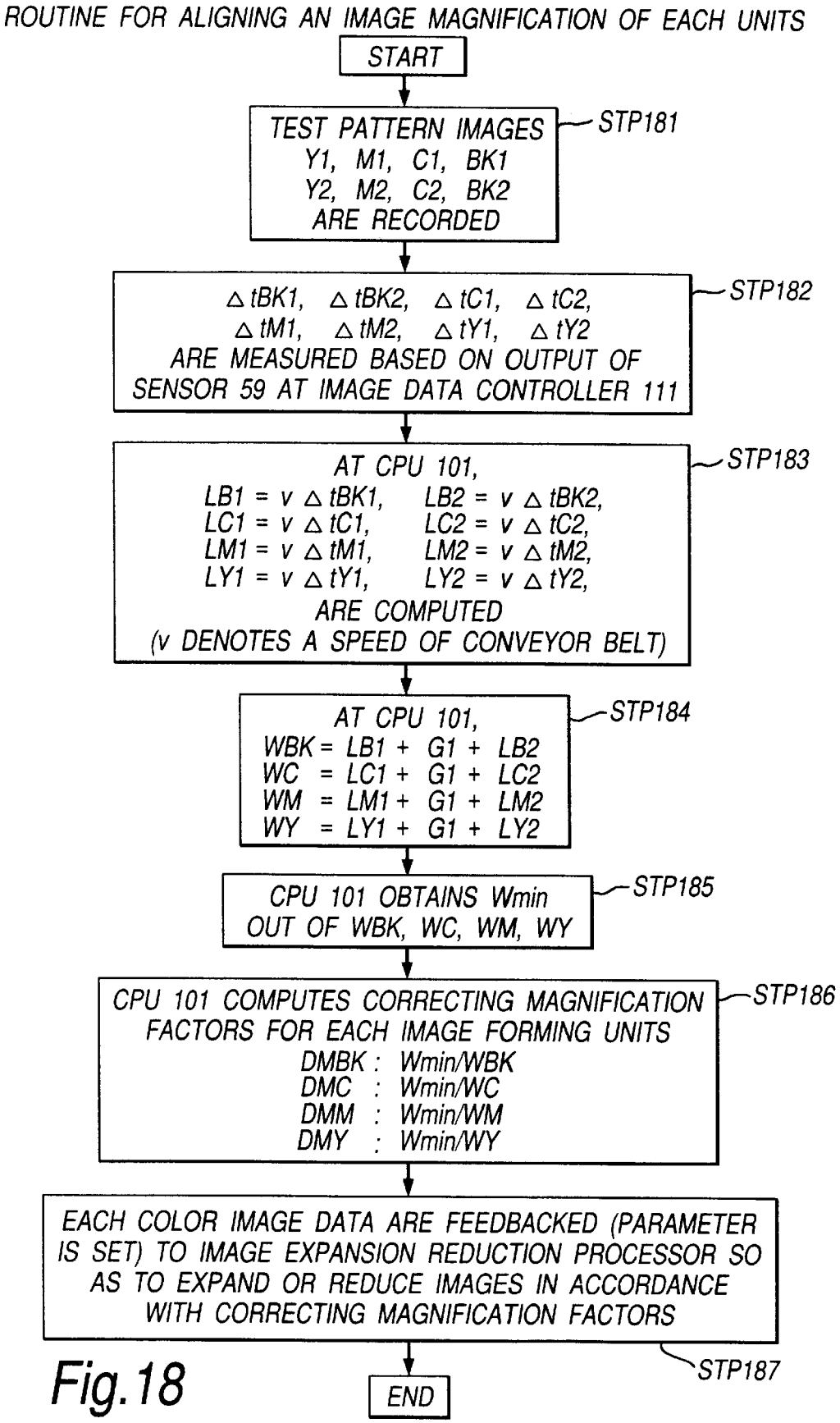
FIG. 18 is a flowchart showing a method to detect a magnification error from the positional relationship between the deviation detecting mechanism and a test pattern image formed on the conveyer belt shown in FIG. 6.

FIG. 22 shows a laser beam system image forming apparatus which may generate a magnification deviation shown in FIG. 18.

An image forming apparatus 500 shown in FIG. 22 has a first through a fourth image forming units 510, 520, 530 and 540 which form images for decomposed color components, that is, Y (Yellow), M (Magenta), C (Cyan) and BK (Black).

The first through the fourth image forming units 510, 520, 530 and 540 are arranged in series in order of the first image forming unit 510, the second image forming unit 520, the third image forming unit 530 and the fourth image forming unit 540 under mirrors 573, 583, 593 and 603 of an optical scanning unit 570.

Under the first through the fourth image forming units 510, 520, 530 and 540, a conveyer belt 551 is arranged for conveying images formed by the image forming units.

The conveyer belt 551 is put over a supporting roller 552 which is rotated in the arrow direction by a motor (not shown) and a following supporting roller 553 and is rotated at a specified speed in the rotating direction of the supporting roller 552.

The first through the fourth image forming units 510, 520, 530 and 540 have photosensitive drums 511, 521, 531 and 541 which are in a cylindrical drum shape, arranged rotatable in the arrow direction and on which electrostatic latent images corresponding to images are formed, respectively.

Around the photosensitive drums 511, 521, 531 and 541, there are arranged charging rollers 512, 522, 532 and 542 which supply specified potential to the surfaces of respective photosensitive drums and developing devices 514, 524, 534 and 544 which develop electrostatic latent images formed on the surfaces of respective photosensitive drums using toners in corresponding colors. Further, there are also transfer rollers 515, 525, 535 and 545 arranged opposing to the photosensitive drums 511, 521, 531 and 541 in the state with the conveyer belt 551 kept between the transfer rollers and the photosensitive drums for transferring toner images formed on the photosensitive drums 511, 521, 531 and 541 on the conveyer belt 551 or a paper P conveyed via the conveyer belt 551. Further, there are also cleaners 516, 526, 536 and 546 for removing residual toners left on the photosensitive drums 511, 521, 531 and 541 after toner images were transferred via the transfer rollers 515, 525, 535 and 545, and discharging devices 517, 527, 537 and 547 for removing residual potential left on the photosensitive drums 511, 521, 531 and 541 after toner images were transferred by the transfer rollers 515, 525, 535 and 545.

The optical scanning unit 570 is comprised of the polygonal mirror PM which leads laser beams from a plurality of laser elements (not shown) to respective mirrors, mirrors 571, 572 and 573 to lead the laser beam reflected on the polygonal mirror PM to the photosensitive drum 511, mirrors 581, 582 and 583 to lead the reflected laser beam to the photosensitive drum 521, mirrors 591, 592 and 593 to lead the reflected laser beam to the photosensitive drum 531, and a mirror 603 to lead the reflected laser beam to the photosensitive drum 541 through a first through a third lenses LN1, LN2 and LN3.

Under the conveyer belt 551, a cassette 555 in which image receiving media, that is, paper P are contained is arranged.

At one side of the cassette 555, which is close to the supporting roller 552, there is a paper supply roller 556 which takes out paper P contained in the cassette 555 by one sheet at a time from the top. Between the paper supply roller 556 and the supporting roller 552, there is an aligning roller 558 to align the leading edge of the paper P taken out of the cassette 555 with the leading edge of a toner image formed on the photosensitive drum 511 of the image forming unit 510.

There is an adsorbing roller 562, which provides a specified electrostatic adsorbing force to the paper P conveyed at a specified timing via the aligning roller 558, between the aligning roller 558 and the first image forming unit 510, near the supporting roller 552 and substantially on the outer surface of the supporting roller 552 with the conveyer belt 551 put between them. The axial line of the adsorbing roller 562 and the supporting roller 552 are arranged in parallel with each other.

There are registration sensors 559 and 560 for detecting the position of an image formed on the conveyer belt 551 at one end of the conveyer belt 551, near the supporting roller 553, substantially on the outer surface of the supporting roller 553 with the conveyer belt 551 put between the sensors 559 and 560 and the supporting roller 553 with a specified space in the axial direction of the supporting roller 553. (FIG. 22 is a front sectional view and therefore, the rear sensor 559 only is shown). The registration sensors 559 and 560 are shown as Reference Numerals 59 and 60, respectively in FIG. 22.

There is a belt cleaner 563 on the conveyer belt 551 corresponding to the outer surface of the supporting roller 553 for removing toners adhered on the conveyer belt 551 or refuse of paper P.

In the conveying direction of paper P by the conveyer belt 551 after separated from the supporting roller 553, there is a fixing device 561 for fixing a toner image on a paper P.

Next, the operation of the image forming apparatus 500 shown in FIG. 22 will be explained.

The image forming apparatus 500 is operable in two modes; an image forming (normal) mode to form an image on the paper P being conveyed by the conveyer belt 551 and a register correction (adjusting) mode to form an image directly on the conveyer belt 551.

Hereinafter, the register correction (adjusting) mode will be explained.

As explained referring to FIG. 10, the intervals $\Delta tBK1$, $\Delta tC1$, $\Delta tM1$, $\Delta tY1$, $\Delta tBK2$, $\Delta tC2$, $\Delta tM2$ and $\Delta tY2$ between two pulses output from the test pattern images BK1, C1, M1, Y2, BK2, C2, M2 and Y2 passing the detecting positions P1 and P2 of the first registration sensor 559 (59) and second registration sensor 560 (60) arranged corresponding to the detecting lines L1 and L2 are replaced by the detecting lines L1 and L2 and the write position of the first straight lines 1L and 1L' of respective test pattern images as already explained using FIG. 9.

That is, the lengths LB1, LC1, LM1 and LY1 of the first straight line 1L and the lengths LB2, LC2, LM2 and LY2 of the first straight line 1L' of the test pattern images, which are shown in FIGS. 11 and 12, provided by the image forming units are shown as follows:

$LB1=v\Delta tBK1$, $LC1=v\Delta tC1$, $LM1=v\Delta tM1$, $LY1=v\Delta tY1$ $LB2=v\Delta tBK2$, $LC2=v\Delta tC2$, $LM2=v\Delta tM2$, and $LY2=v\Delta tY2$ Then, widths (hereinafter referred to as the write widths) W of test pattern images are obtained based on LB1, LC1, LM1, LY1, LB2, LC2, LM2 and LY2 obtained as described above.

Here, as the distance between the first and the second registration sensors 559 (59) and 560 (60) in the main scanning direction is G1 as already explained referring to FIG. 6, the write widths WBK, WC, WM and WY of the image forming units 510, 520, 530 and 540 are defined as follows:

$WBK \rightarrow LB1+G1+LB2$, $WC \rightarrow LC1+G1+LC2$, $WM \rightarrow LM1+G1+LM2$, and $WY \rightarrow LY1+G1+LY2$ Then, the minimum write width Wmin is obtained from the write widths WBK, WC, WM and WY thus obtained.

In succession, to give a specified magnification to image data when writing them so that lengths of image data corresponding to respective colors that are written on corresponding photosensitive drums, that is, the write widths become substantially the same based on the Wmin, magnifications DMBK, DMC, DMM and DMY to respective image data are defined as follows:

$DMBK \rightarrow Wmin/WBK$, $DMC \rightarrow Wmin/WC$, $DMM \rightarrow Wmin/WM$, and $DMY \rightarrow Wmin/WY$ The magnifications for respective image data of the yellow, magenta, cyan and black image forming units 510, 520, 530 and 540 are thus defined and expansion or reduction magnifications of image data are set in the image data controller 111 by the image expansion reduction processors 313, 323, 333 and 343 of the image data controller 112. Further, the magnifications supplied to respective image data are stored in the NVM 104.

In the laser beam printer shown in FIG. 22, magnification errors are easily adjusted as, for instance, driving pulse frequency supplied to a laser driving unit (not shown) which energizes a plurality of corresponding laser elements (not shown) is optionally changed by an oscillation frequency variable circuit (not shown) in order for applying laser beams to the photosensitive drums 511, 521, 531 and 541 of the image forming units 510, 520, 530 and 540.

In the embodiment described above, test patterns were formed directly on the conveyer belt but they may be formed on a paper that is conveyed by the conveyer belt.

As described above, according to the image forming apparatus of the present invention, images formed by the imaging bars, which form latent images on the photosensitive drum, on a plurality of photosensitive drums provided corresponding to decomposed color components are converted into toner images corresponding to respective color components by the developing devices, transferred on the conveyer belt, conveyed by the conveyer belt and then, relative deviations among each of colors are computed by the first and the second registration sensors. As a result, factors for color discrepancies which tend to occur, for instance, a tilt of respective photosensitive drums against the conveyer belt, a deviation in spaces among respective photosensitive drums, a deviation in the direction orthogonal to the direction in which respective photosensitive drums and the conveyer belt are rotated, and differences among image magnifications etc. when toner images corresponding to color components are superposed each other are detected easily.

Based on the factors for color discrepancies thus obtained, it is possible to easily remove color discrepancies of images which are output by changing the positions of image data in the memory, which are supplied to the specified light source of the imaging bars and the light emitting timing of the imaging bars and by rotating image data corresponding to the tilts of the imaging bars.

Further, even when the first and the second registration sensors are mounted away from the same line in the main scanning direction, color deviations can be prevented positively by correcting errors of output signals corresponding to the shifted mounting positions of the first and the second registration sensors.

What is claimed is:

1. An image forming apparatus which has image forming means to transfer images on an image receiving medium that is moved in a specified direction together with a conveying means which conveys the image receiving medium, comprising:

means for forming test patterns on the conveying means or the image receiving medium by the image forming means, the test patterns including a leading edge and a trailing edge along the specified direction defining a distance therebetween, the distance varying continuously;

first detection means for detecting the timing of the leading edge and the trailing edge of a test pattern crossing the first detection means downstream of the image forming means,the first detection means including a light source, a first optical fiber element for guiding light from the light source and illuminating the conveying means to obtain reflected light, a second optical fiber element for guiding the reflected light, and a light receiving element for converting the reflected light guided by the second optical fiber element into an electric signal;

second detection means for detecting a shift of an image formed by the image forming means from a proper position to a shifted position based on the difference in the detected timings from the leading edge to the trailing edge of the test pattern detected by the first detection means; and means for correcting a shift of an image formed by the image forming means based on the shifted position of the image detected by the second detection means.

2. An image forming apparatus as claimed in claim 1, wherein the test pattern is formed by a first straight line extending at a right angle to the moving direction of the conveying means and a second straight line which is not in parallel with the first straight line and crosses the first straight line at a specified angle.

3. An image forming apparatus as claimed in claim 2, wherein the test pattern is formed with a space formed between the first straight line and the second straight line smeared out.

4. An image forming apparatus as claimed in claim 1, wherein the test pattern is formed by a single straight line extending at a right angle to the moving direction of the conveying means and a single secondary curve extending from one end of the single straight line.

5. An image forming apparatus as claimed in claim 4, wherein the test pattern is formed with a space formed between the single straight line and the secondary curve smeared out.

6. An image forming apparatus as claimed in claim 1, wherein the test pattern is formed by a single secondary curve extending at a right angle to the moving direction of the conveying means.

7. An image forming apparatus as claimed in claim 6, wherein the test pattern is formed with a space enclosed by the secondary curve smeared out.

8. An image forming apparatus which has a plurality of image forming means to transfer images on an image receiving medium that is moved in a specified direction together with a conveying means which conveys the image receiving medium, comprising:

means for forming test patterns on the conveying means or the image receiving medium by the plurality of image forming means, the test patterns including a leading edge and a trailing edge along the specified direction defining a distance therebetween, the distance varying continuously;

means, positioned above the conveying means downstream of the plural image forming means and at points facing the conveying means or the surface of the side of the image receiving medium where images are formed, for detecting the crossing of two points of a respective test pattern, the detecting means including a light source, a first optical fiber element for guiding light from the light source and illuminating the conveying means to obtain reflected light, a second optical fiber element for guiding the reflected light, and a light receiving element for converting the reflected light guided by the second optical fiber element into an electric signal;

computing means for obtaining positions of images formed by the image forming means through computation from a difference in detecting timings of the two points of the respective test pattern; and means for correcting positions of images formed by the plural image forming means to the proper position based on the result of computation by the computing means.

9. An image forming apparatus as claimed in claim 8, wherein the test pattern is formed by a first straight line extending at a right angle to the moving direction of the conveying means and a second straight line which is not in parallel with the first straight line and crosses the first straight line at a specified angle.

10. An image forming apparatus as claimed in claim 9, wherein the test pattern is foamed with a space formed between the first straight line and the second straight line smeared out.

11. An image forming apparatus as claimed in claim 8, wherein the test pattern is formed by a single straight line extending at a right angle to the moving direction of the conveying means and a single secondary curve extending from one end of the single straight line.

12. An image forming apparatus as claimed in claim 11, wherein the test pattern is formed with a space formed between the single straight line and the secondary curve smeared out.

13. An image forming apparatus as claimed in claim 8, wherein the test pattern is formed by a single secondary curve extending at a right angle to the moving direction of the conveying means.

14. An image forming apparatus as claimed in claim 13, wherein the test pattern is formed with a space enclosed by the secondary curve smeared out.

15. An image forming apparatus which has image forming means to transfer images on an image receiving medium that is moved in a specified direction together with a conveying means which conveys the image receiving medium, comprising:

means for forming first and second test patterns on the conveying means or the image receiving medium by the image forming means along the direction orthogonal to the specified direction, the first and second test patterns, which are formed at first and second positions, respectively, in the direction orthogonal to the specified direction, each including a leading edge and a trailing edge along the specified direction defining a distance therebetween, the distance varying continuously;

first detection means for detecting the timing of the leading edge and the trailing edge of the first test pattern to cross the first detection means, the first detection means including a first light source, a first light introducing optical fiber element for guiding light from the first light source and illuminating the conveying means to obtain reflected light, a first light pickup optical fiber element for guiding the reflected light, and a first light receiving element for converting the reflected light guided by the first light pickup optical fiber element into an electric signal;

second detection means, arranged along the direction orthogonal to the specified direction, for detecting the timing of the leading edge and the trailing edge of the second pattern to cross the second detection means, the second detection means including a second light source, a second light introducing optical fiber element for guiding light from the second light source and illuminating the conveying means to obtain reflected light, a second light pickup optical fiber element for guiding the reflected light, and a second light receiving element for converting the reflected light guided by the second light pickup optical fiber element into an electric signal;

third detection means for detecting a shift of an image formed by the image forming means from a proper position to a shifted position based on the detected timings from the leading edge to the trailing edge of each of the test patterns detected by the first and second detection means; and means for correcting a shift of an image formed by the image forming means based on the shifted position of the image detected by the third detection means.

16. An image forming apparatus which has image forming means to transfer images on an image receiving medium that is moved in a specified direction together with a conveying means which conveys the image receiving medium, comprising:

means for forming first and second test patterns on the conveying means or the image receiving medium by the image forming means along the direction orthogonal to the specified direction, the first and second test patterns formed at first and second positions, respectively, in the direction orthogonal to the specified direction;

first detection means for detecting the first test pattern;

second detection means, arranged along the direction orthogonal to the specified direction, for detecting the second test pattern;

third detection means for detecting a shift of an image formed by the image forming means from a proper position to a shifted position based on the detected test patterns detected by the first and second detection means;

first correction means for correcting a shift of the image formed by the image forming means based on the shift detected by the third detection means;

a reference pattern formed in advance on the conveying means or the image receiving medium at a position along the direction orthogonal to the specified direction and detected by the first and the second detection means;

fourth detection means for detecting a shift of the arranged positions of the first and second detection means based on the difference in timing of the reference pattern crossing the first and the second detection means; and second correction means for correcting the detecting operation of the third detection means based on said shift of said arranged positions detected by the fourth detection means.

17. A sensor position shift correcting apparatus comprising:

a first sensor, arranged at a specified position, for detecting an image to be detected that is moved relatively in a first direction and output a detection signal;

a second sensor, arranged along a specified second direction against the first sensor, for detecting an image to be detected that is moved relatively in the first direction and output a detection signal;

means for moving a reference image positioned along the second direction to the detecting positions of the first and the second sensors in the first direction relatively to the first and the second sensors;

means for detecting a shift of the positions of the first and second sensors in the first direction based on the detection signal for the reference image; and means for correcting the detection signals output from the first and the second sensors corresponding to the shift of the positions detected by the detecting means.

18. In an image forming apparatus including means for conveying an image receiving medium in a first direction at a prescribed moving speed and plural image forming means for forming an image on the image receiving medium conveyed by the conveying means, a method for correcting a shift of an image formed by an image forming means in a second direction orthogonal to the first direction, comprising the steps of:

forming test patterns by each of the plural image forming means on the conveying means or the image receiving medium, each of the test patterns including a leading edge and a trailing edge along the first direction defining a distance therebetween, the distance varying continuously;

detecting spacing times between the leading edge and the trailing edge of each of the test patterns downstream of the image forming means;

computing products of the spacing times detected in the detecting step and the prescribed moving speed of the conveying means;

obtaining a minimum value of the values obtained in the computing step;

obtaining shift amounts of the test patterns from differences between the values obtained in the computing step and the minimum value; and correcting the shift of each image formed by the image forming means in the second direction based on the shift amounts.

19. In an image forming apparatus including means for conveying an image receiving medium in a prescribed direction and at least first, second and third image forming means for forming an image on the image receiving medium conveyed by the conveying means, a method for correcting a shift of the image formed by the image forming means in the prescribed direction from a proper position, comprising the steps of:

forming first, second and third test patterns by the first, second and third image forming means on the conveying means or the image receiving medium;

detecting a first spacing time between the first and the third test patterns, and a second spacing time between the first and the second test patterns;

obtaining image forming timings of the first, second and third image forming means using the first spacing time and the second spacing time; and changing image forming positions so that the first, second and third image forming means form images according to the image forming timings.

20. In an image forming apparatus including means for conveying an image receiving medium in a first direction and plural image forming means for forming an image on the image receiving medium conveyed by the conveying means, a method for correcting images from tilting against an image at a proper position, comprising the steps of:

forming a pair of test patterns spaced from each other in a second direction orthogonal to the first direction on the conveying means or the image receiving medium for each of the plural image forming means;

detecting spacing times between a pair of test patterns corresponding to each of the image forming means based on times of the test patterns to pass through a first detecting position and a second detecting position which are arranged with a prescribed gap between them along the second direction;

computing tilting angles of each of the image forming means in the first direction based on a dimensional value of the gap between the first and the second detecting positions and the spacing times obtained in the detecting step; and adjusting the image forming angles of the image forming means so that the tilting is minimized according to the tilting angles obtained in the computing step.

21. In an image forming apparatus including means for conveying an image receiving medium in a first direction at a prescribed moving speed and plural image forming means for forming an image on the image receiving medium conveyed by the conveying means, a method for correcting a shift in either expansion or reduction of images formed by the image forming means in a second direction orthogonal to the first direction from a proper sized image, comprising the steps of:

(a) forming a pair of test patterns spaced from each other in the second direction on the conveying means or the image receiving medium for each of the plural image forming means, each of the test patterns including a leading edge and a trailing edge along the first direction defining a distance therebetween, the distance varying continuously;

(b) detecting spacing times of each of the test pattern pairs from the leading edge to the trailing edge based on times of the test pattern pairs to pass a first detecting position and a second detecting position which are arranged with a prescribed gap provided along the second direction;

(c) computing products of the spacing times detected in step (b) and the moving speed of the conveying means;

(d) computing sums of a value of a space of each of the test pattern pair from one end to another end obtained in step (c) and a dimensional value of the prescribed gap;

(e) obtaining a minimum value among the values obtained in step (d);

(f) computing correcting magnification factors corresponding to the image forming means by dividing the minimum value by the values obtained in step (d); and (g) changing image forming magnifications so that each of the image forming means forms an image according to the correcting magnification factors obtained in step (f).

* * * * *